US008795940B2

(12) United States Patent
Sugimoto et al.

(10) Patent No.: US 8,795,940 B2
(45) Date of Patent: Aug. 5, 2014

(54) TONER AND DEVELOPER

(71) Applicants: Tsuyoshi Sugimoto, Shizuoka (JP); Hiroshi Yamashita, Shizuoka (JP); Daisuke Asahina, Shizuoka (JP); Rintaro Takahashi, Miyagi (JP); Masahide Yamada, Shizuoka (JP); Shinya Nakayama, Shizuoka (JP); Atsushi Yamamoto, Shizuoka (JP); Shingo Sakashita, Shizuoka (JP)

(72) Inventors: Tsuyoshi Sugimoto, Shizuoka (JP); Hiroshi Yamashita, Shizuoka (JP); Daisuke Asahina, Shizuoka (JP); Rintaro Takahashi, Miyagi (JP); Masahide Yamada, Shizuoka (JP); Shinya Nakayama, Shizuoka (JP); Atsushi Yamamoto, Shizuoka (JP); Shingo Sakashita, Shizuoka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 13/684,883

(22) Filed: Nov. 26, 2012

(65) Prior Publication Data

US 2013/0157184 A1 Jun. 20, 2013

(30) Foreign Application Priority Data

Dec. 15, 2011 (JP) ..... 2011-274074
Sep. 26, 2012 (JP) ..... 2012-211947

(51) Int. Cl.
*G03G 9/08* (2006.01)

(52) U.S. Cl.
USPC ..... 430/109.4; 430/111.4; 399/252

(58) Field of Classification Search
USPC ..... 430/109.4, 111.4; 399/252
See application file for complete search history.

(56) References Cited

U.S. PATENT DOCUMENTS

| | | | |
|---|---|---|---|
| 2006/0057488 | A1 | 3/2006 | Inoue et al. |
| 2006/0204880 | A1 | 9/2006 | Mizutani et al. |
| 2008/0050669 | A1 | 2/2008 | Ohmura et al. |
| 2010/0129748 | A1 | 5/2010 | Inoue et al. |
| 2010/0310980 | A1 | 12/2010 | Sugimoto et al. |
| 2011/0223532 | A1 | 9/2011 | Sugimoto et al. |
| 2011/0262856 | A1 | 10/2011 | Sugimoto et al. |
| 2012/0052434 | A1 | 3/2012 | Sugimoto et al. |
| 2012/0122027 | A1 | 5/2012 | Watanabe et al. |
| 2012/0189951 | A1 | 7/2012 | Sugimoto et al. |

FOREIGN PATENT DOCUMENTS

| | | |
|---|---|---|
| JP | 08-176310 | 7/1996 |
| JP | 2579150 | 11/1996 |
| JP | 11-133665 | 5/1999 |
| JP | 2001-158819 | 6/2001 |
| JP | 2002-287400 | 10/2002 |
| JP | 2002-351143 | 12/2002 |
| JP | 2005-015589 | 1/2005 |
| JP | 2012-168505 | 9/2012 |

OTHER PUBLICATIONS

U.S. Appl. No. 13/593,956, filed Aug. 24, 2012, Sugimoto, et al.
Extended Search Report issued Apr. 2, 2013 in European Patent Application No. 12194649.5.

*Primary Examiner* — Mark A Chapman
(74) *Attorney, Agent, or Firm* — Oblon, Spivak, McClelland, Maier & Neustadt, L.L.P.

(57) ABSTRACT

To provide a toner, including at least: a non-crystalline polyester resin; and a crystalline polyester resin, wherein the toner has a glass transition temperature in a first heating Tg1st and a glass transition temperature in a second heating Tg2nd, and a difference between Tg1st and Tg2nd (Tg1st-Tg2nd) is 10° C. or greater, and wherein the crystalline polyester resin is a modified crystalline polyester resin having a urethane skeleton or a urea skeleton, or both thereof.

10 Claims, No Drawings

TONER AND DEVELOPER

BACKGROUND OF THE INVENTION

1. Field of the Invention

The present invention relates to a toner and a developer.

2. Description of the Related Art

In recent years, a toner is required to have a small particle diameter for achieving a high-quality output image, high temperature-resistant offset property, low-temperature fixing property for energy conservation, and heat-resistant storage stability for enduring high-temperature and high-humidity conditions during storage or transportation after manufacturing. In particular, improvement of low-temperature fixing property is extremely important since power consumption during fixing consumes a lot of power in an image formation process.

Conventionally, a toner manufactured by a kneading pulverization method has been used. The toner manufactured by a kneading pulverization method has problems such as insufficient quality of an output image and high fixing energy because it is difficult to reduce its particle diameter, its shape is non-uniform, and its particle diameter distribution is broad. Also, when a wax (releasing agent) is added for improving fixability, the toner manufactured by a kneading pulverization method cracks at an interface of the wax during pulverization, and the wax is present in abundance at a surface of the toner. Thus, while it provides a releasing effect, adhesion of the toner to a carrier, a photoconductor and a blade (filming) is more likely to occur, and there is a problem that overall performance is not satisfactory.

Therefore, in order to overcome the above problems of the kneading pulverization method, a method for manufacturing a toner by a polymerization method is proposed. For a toner manufactured by a polymerization method, reduction of particle diameter is easy, and the toner has a sharp particle size distribution compared to a particle size distribution of the toner manufactured by a pulverization method. Further, encapsulation of a releasing agent is possible. As a method for manufacturing a toner by a polymerization method, for the purpose of improving low-temperature fixing property and improving high temperature-resistant offset property, a method for manufacturing a toner from an elongation reaction product of a urethane-modified polyester as a toner binder is proposed (for example, see Japanese Patent Application Laid-Open (JP-A) No. 11-133665).

Also, a method for manufacturing a toner which has superior powder flowability and transfer property with a reduced particle diameter as well as superior heat-resistant storage stability, low-temperature fixing property and high temperature-resistant offset property is proposed (for example, see JP-A Nos. 2002-287400 and 2002-351143).

Also, a method for manufacturing a toner including an aging step for manufacturing a toner binder having a stable molecular weight distribution and achieving both low-temperature fixing property and high temperature-resistant offset property is proposed (for example, Japanese Patent (JP-B) No. 2579150 and JP-A No. 2001-158819).

However, these proposed methods do not satisfy a high level of low-temperature fixing property required in recent years.

Thus, for the purpose of obtaining a high level of low-temperature fixing property, a toner which includes: a resin including a crystalline polyester resin; and a releasing agent and which has a sea-island phase separation structure due to the resin and a wax mutually incompatible is proposed (for example, JP-A No. 08-176310).

Also, a toner including a crystalline polyester resin, a releasing agent and a graft polymer is proposed (for example, JP-A No. 2005-15589).

With these proposed technologies, low-temperature fixing may be achieved because a crystalline polyester resin rapidly melts compared to a non-crystalline polyester resin. However, even when the crystalline polyester resin corresponding to an island in the sea-island phase separation structure, the non-crystalline polyester resin corresponding to a sea as a major portion does not still melt. Then, fixing does not occur until both the crystalline polyester resin and the non-crystalline polyester resin melt to some degree, and these proposed technologies do not satisfy a high level of low-temperature fixing property demanded further in recent years.

Accordingly, a toner causing no filming and having superior low-temperature fixing property, high temperature-resistant offset property and heat-resistant storage stability is desired at present.

SUMMARY OF THE INVENTION

The present invention aims at providing a toner causing no filming and having superior low-temperature fixing property, high temperature-resistant offset property, and heat-resistant storage stability.

Means for solving the problems are as follows. That is:

A toner of the present invention includes at least a non-crystalline polyester resin and a crystalline polyester resin, wherein the toner has a glass transition temperature in the first heating Tg1st and a glass transition temperature in the second heating Tg2nd, and a difference between Tg1st and Tg2nd (Tg1st−Tg2nd) is 10° C. or greater, and wherein the crystalline polyester resin is a modified crystalline polyester resin including a urethane skeleton or a urea skeleton, or both thereof.

According to the present invention, it is possible to solve the conventional problems and to provide a toner causing no filming and having superior low-temperature fixing property, high temperature-resistant offset property, and heat-resistant storage stability.

DETAILED DESCRIPTION OF THE INVENTION ( Toner)

A toner of the present invention includes at least a non-crystalline polyester resin and a crystalline polyester resin, and it further includes other components according to necessity.

The toner has a glass transition temperature in a first heating Tg1st and a glass transition temperature in a second heating Tg2nd, and a difference therebetween (Tg1st−Tg2nd) is 10° C. or greater, and the crystalline polyester resin is a modified crystalline polyester resin having a urethane skeleton or a urea skeleton, or both thereof.

<Modified Crystalline Polyester Resin>

The modified crystalline polyester resin is a modified crystalline polyester resin including at least a urethane skeleton or a urea skeleton, or both thereof. Due to its high crystallinity, it exhibits a hot-melt property that its viscosity rapidly decreases near a fixing starting temperature.

By using the modified crystalline polyester having such properties with the non-crystalline polyester resin as a main component in the toner, the toner exhibits favorable heat-resistant storage stability due to crystallinity right before a melt starting temperature. At the melt starting temperature, a rapid viscosity decrease (sharp melt property) occurs due to melting of the modified crystalline polyester resin, which becomes compatible with the non-crystalline polyester resin, and the toner fixes due to the rapid viscosity decrease. Accordingly, the obtained toner has both favorable heat-resistant storage stability and low-temperature fixing property. Also, it shows a favorable result of a release width (difference between a lower-limit fixing temperature and a high-temperature-resistant offset occurrence temperature).

A toner has superior low-temperature fixing property when the crystalline polyester resin is a non-modified crystalline polyester resin and is easily miscible with the non-crystalline polyester resin. However, a spent of the crystalline polyester resin tends to occur in a developing apparatus due to decrease in strength of the crystalline polyester resin in the toner, an image tends to degrade due to occurrence of filming, and the toner is likely to have degraded high-temperature and high-humidity resistant storage stability due to dissolution of a low-molecular weight component of the crystalline polyester resin with the non-crystalline polyester resin.

In particular, in a high-temperature and high-humidity environment, dissolution of the low-molecular weight component of the crystalline polyester resin in the non-crystalline polyester resin is more likely to proceed, which tends to cause an agglomeration or fusion of the toner in a toner bottle or a developing cartridge, and image defect accompanied by them is likely to occur.

Also, near a fixing temperature, a difference between a melt viscosity of the crystalline polyester resin and a melt viscosity of the non-crystalline polyester resin is extremely large, and the crystalline polyester resin in a form of a liquid is difficult physically to mix with the non-crystalline polyester resin near a form of a solid. Dissolution of the crystalline polyester resin does not sufficiently proceed, which makes it difficult to sufficiently exert low-temperature fixing property.

In the present invention, as a result of extensive studies to solve these problems, it has been found that these problems may be solved by introducing a urethane and/or the urea group skeleton in the crystalline polyester resin.

By introducing a urethane or a urea skeleton having a high cohesive force, the crystalline polyester resin has an improved hardness, and the spent and the filming in the developing apparatus may be prevented.

Also, subjecting the crystalline polyester resin to a urethane or a urea bonding may increase a molecular weight of the crystalline polyester resin and reduces a low-molecular weight component of the crystalline polyester resin, and it is possible to prevent reduction of high-temperature and high-humidity resistant storage stability of the toner due to dissolution with the non-crystalline resin.

Further, introduction of the urethane or the urea group skeleton increases the melt viscosity of the crystalline polyester resin, which physically improves compatibility with the non-crystalline polyester resin, and accordingly low-temperature fixing property may improve.

The crystalline polyester resin of the present invention is a urethane and/or a urea-modified crystalline polyester resin. The urethane and/or the urea-modified polyester resin are a resin obtained by reacting a polyester resin having an isocyanate group at an end thereof with a hardening agent having an active hydrogen group.

A maximum peak temperature (melting point) of a heat of fusion of the modified crystalline polyester resin is not particularly restricted and may be appropriately selected according to purpose. Nonetheless, in view of achieving both low-temperature fixing property and heat-resistant storage stability, it is preferably 50° C. or greater and less than 80° C., more preferably 55° C. to 75° C., and particularly preferably 60° C. to 70° C. When the maximum peak temperature is less than 50° C., low-temperature fixing property improves, but heat-resistant storage stability degrades. To the contrary, when it is 80° C. or greater, heat-resistant storage stability improves, but low-temperature fixing property degrades.

Regarding viscoelastic properties of the modified crystalline polyester resin, a storage elastic modulus G' at a melting point+20° C. is not particularly restricted and may be appropriately selected according to purpose. Nonetheless, it is preferably $1.0\times10^2$ Pa·s or greater and less than $5.0\times10^5$ Pa·s, and more preferably $1.0\times10^3$ Pa·s or greater and less than $1.0\times10^5$ Pa·s. Thus, regarding the viscoelastic properties of the toner of the present invention, when G' at a melting point+20° C. is less than $1.0\times10^2$ Pa·s, a difference of melt viscosity of the non-crystalline polyester resin near a fixing temperature increases, and it becomes difficult to dissolve physically the modified crystalline polyester resin with the non-crystalline polyester resin become physically, and low-temperature fixing property may degrade. Also, due to low strength of the modified crystalline polyester resin, and the spent or the filming in the developing apparatus may easily occur.

Also, when G' at a melting point+20° C. is $5.0\times10^5$ Pa·s or greater, viscosity decrease sufficient for fixing the modified crystalline polyester does not occur, and low-temperature fixing property may degrade.

The viscoelastic properties of the modified crystalline polyester resin may be obtained by adjusting a concentration of the urethane or the urea group in a crystalline monomer which constitutes the resin or a molecular weight of the resin. For example, a value of G' increases by increasing the concentration of the urethane or the urea group, or increasing the molecular weight.

The weight-average molecular weight (Mw) of the modified crystalline polyester resin is not particularly restricted and may be appropriately selected according to purpose. Nonetheless, in a GPC measurement of a component soluble to ortho-dichlorobenzene, it is preferable that the weight-average molecular weight (Mw) is 10,000 or greater, and 50,000 or less, that a ratio of a component having a molecular weight of 1,000 or less is less than 2% by mass, and that a ratio of a component having a molecular weight of 500 or less is less than 1% by mass.

When the Mw is less than 10,000, the modified crystalline polyester resin has a low molecular weight and becomes miscible with the non-crystalline polyester resin; and high-temperature and high-humidity resistant storage stability may degrade. Also, when the Mw exceeds 50,000, due to decreased compatibility with the non-crystalline polyester resin, low-temperature fixing property may degrade.

When the ratio of the molecular weight of 1,000 or less is 2% by mass or greater, due to a large amount of the low-molecular weight component miscible with the non-crystalline polyester, high-temperature and high-humidity resistant storage stability may degrade.

When the ratio of the molecular weight of 500 or less is 1% by mass or greater, due to a large amount of the low-molecular weight component miscible with the non-crystalline polyester, high-temperature and high-humidity resistant storage stability may degrade. A ratio of the molecular weight of 1,000 or less and a ratio of the molecular weight of 500 or less are not particularly restricted and may be appropriately selected according to purpose, but the smaller ratios are more preferable.

The molecular weight of the modified crystalline polyester resin may be adjusted by means of a ratio of an acid monomer and an alcohol monomer during a reaction of the modified crystalline polyester resin, an amount of a catalyst during a polymerization reaction, a reaction time and a degree of pressure reduction, and further reduction of the low-molecular weight component is possible by binding within the crystalline polyester with a urethane or a urea reaction.

A content of the modified crystalline polyester resin is not particularly restricted and may be appropriately selected according to purpose. Nonetheless, in the toner, it is preferably 5% by mass or greater and less than 20% by mass, and more preferably 7% by mass to 15% by mass. When the content is less than 5% by mass, low-temperature fixing property may be inferior due to insufficient sharp melting by the crystalline polyester resin. When it is 20% by mass or greater, heat-resistant storage stability may degrade, and image fogging may be likely to occur. The content within the more preferable range is advantageous since it provides high-quality image, high stability and superior low-temperature fixing property.

A monomer used for the crystalline polyester resin of the modified crystalline polyester resin is not particularly restricted. Examples thereof include a polycondensed polyester resin synthesized from a polyol and a polycarboxylic acid described hereinafter, a lactone ring-opening polymerization product, and a polyhydroxycarboxylic acid. Among these, it is preferable to have a structural unit derived from an aliphatic dicarboxylic acid and a structural unit derived from an aliphatic diol, and a polycondensed polyester of an aliphatic diol and an aliphatic dicarboxylic acid is particularly preferable since it has high crystallinity and may achieve both low-temperature fixing property and heat-resistant storage stability at a high level.

—Polyol—

Examples of the polyol include diols and polyols having 3 to 8 or higher valences.

The diols are not particularly restricted and may be appropriately selected according to purpose. Examples thereof include: an aliphatic diol such as straight-chain aliphatic diol and a branched aliphatic diol; alkylene ether glycols having 4 to 36 carbon atoms; an alicyclic diol having 4 to 36 carbon atoms; an alkylene oxide (hereinafter, it may be abbreviated as AO) of the alicyclic diol; an AO adduct of bisphenols; a polylactonediol; a polybutadienediol; a diol having a carboxyl group, a diol having a sulfonic acid group or a sulfamic acid group; and a diol having other functional groups such as salt thereof. Among these, an aliphatic diol having 2 to 36 carbon atoms in the chain is preferable, and a straight-chain aliphatic diol is more preferable. These may be used alone or in combination of two or more.

A content of the straight-chain aliphatic diol with respect to the whole diol is not particularly restricted and may be appropriately selected according to purpose. Nonetheless, it is preferably 80% by mole or greater, and more preferably 90% by mole or greater. The content of 80% by mole or greater is preferable since the resin has improved crystallinity, both low-temperature fixing property and heat-resistant storage stability may be achieved, and the resin has improved hardness.

The straight-chain aliphatic diol is not particularly restricted and may be appropriately selected according to purpose. Examples thereof include ethylene glycol, 1,3-propanediol, 1,4-butanediol, 1,5-pentanediol, 1,6-hexanediol, 1,7-heptanediol, 1,8-octanediol, 1,9-nonanediol, 1,10-decanediol, 1,11-undecanediol, 1,12-dodecanediol, 1,13-tridecanediol, 1,14-tetradecanediol, 1,18-octadecanediol, and 1,20-eicosanediol. Among these, in view of easy availability, ethylene glycol, 1,3-propanediol, 1,4-butanediol, 1,6-hexanediol, 1,9-nonanediol, and 1,10-decanediol are preferable.

The branched aliphatic diol having 2 to 36 carbon atoms in the chain is not particularly restricted and may be appropriately selected according to purpose. Examples thereof include 1,2-propylene glycol, butanediol, hexanediol, octanediol, decanediol, dodecanediol, tetradecanediol, neopentylglycol, and 2,2-diethyl-1,3-propanediol.

The alkylene ether glycols having 4 to 36 carbon atoms are not particularly restricted and may be appropriately selected according to purpose. Examples thereof include diethylene glycol, triethylene glycol, dipropylene glycol, polyethylene glycol, polypropylene glycol and polytetramethylene ether glycol.

The alicyclic diol having 4 to 36 carbon atoms is not particularly restricted and may be appropriately selected according to purpose. Examples thereof include 1,4-cyclohexane dimethanol and hydrogenated bisphenol A.

The alkylene oxide (hereinafter also referred to as AO) of the alicyclic diol is not particularly restricted and may be appropriately selected according to purpose. Examples thereof include adducts (with an addition of 1 to 30 moles) of ethylene oxide (hereinafter also referred to as EO), propylene oxide (hereinafter also referred to as PO), and butylene oxide (hereinafter also referred to as BO).

The bisphenols are not particularly restricted and may be appropriately selected according to purpose. Examples thereof include an AO (EO, PO, BO, etc.) adduct (with an addition of 2 to 30 moles) of bisphenol A, bisphenol F, bisphenol S etc.

The polylactone diol is not particularly restricted and may be appropriately selected according to purpose. Examples thereof include poly-ϵ-caprolactone diol.

The diol having a carboxyl group is not particularly restricted and may be appropriately selected according to purpose. Examples thereof include dialkylol alkanoic acid having 6 to 24 carbon atoms such as 2,2-dimethylol propionic acid (DMPA), 2,2-dimethylol butanoic acid, 2,2-dimethylol heptanoic acid, and 2,2-dimethylol octanoic acid.

The diol having a sulfonic acid group or a sulfamic acid group is not particularly restricted and may be appropriately selected according to purpose. Examples thereof include a sulfamic acid diol such as N,N-bis(2-hydroxyethyl)sulfamic acid and a PO 2-mole adduct of N,N-bis(2-hydroxyethyl) sulfamic acid [N,N-bis(2-hydroxyalkyl)sulfamic acid (with the alkyl group having 1 to 6 carbon atoms) and an AO adduct thereof (EO or PO, etc. as the AO, and the AO with an addition of 1 to 6 moles)]; and bis(2-hydroxyethyl)phophate.

A neutralizing base of the diols having a neutralizing base thereof is not particularly restricted and may be appropriately selected according to purpose. Examples thereof include a tertiary amine having 3 to 30 carbon atoms (e.g. triethylamine, etc.), and an alkali metal (e.g. sodium salt, etc.).

Among these, the alkylene glycol having 2 to 12 carbon atoms, the diol having a carboxyl group, the AO adduct of bisphenols, and a combination thereof are preferable.

Also, the polyol having 3 to 8 or higher valences used according to necessity is not particularly restricted and may be appropriately selected according to purpose. Examples thereof include: an alkanepolyol and an intramolecular or intermolecular dehydration product thereof (e.g. glycerin, trimethylolethane, trimethylolpropane, pentaerythritol, sorbitol, sorbitan, polyglycerin, etc.), a polyhydric aliphatic alcohol having 3 to 8 or higher valences and having 3 to 36 carbon atoms such as sugar and derivative thereof (e.g. sucrose, methylglycoside, etc.); an AO adduct (with an addition of 2 to 30 moles) of trisphenols (trisphenol PA, etc.); an AO adduct (with an addition of 2 to 30 moles) of a novolak resin (e.g. phenol novolak, cresol novolak, etc.); and an acrylic polyol such as copolymer of hydroxyethyl(meth)acrylate and other vinyl monomers. Among these, the polyhydric aliphatic alcohols having 3 to 8 or higher valences and the AO adduct of a novolak resin are preferable, and the AO adduct of a novolak resin is more preferable.

—Polycarboxylic Acid—

Examples of the polycarboxylic acid include a dicarboxylic acid and a polycarboxylic acid having 3 to 6 or higher valences.

The dicarboxylic acid is not particularly restricted and may be appropriately selected according to purpose. Favorable examples thereof include: an aliphatic dicarboxylic acid such as straight-chain aliphatic dicarboxylic acid and branched aliphatic dicarboxylic acid; and an aromatic dicarboxylic acid. Among these, the straight-chain aliphatic dicarboxylic acid is more preferable.

The aliphatic dicarboxylic acid is not particularly restricted and may be appropriately selected according to purpose. Favorable examples thereof include: alkanedicarboxylic acids having 4 to 36 carbon atoms such as succinic acid, adipic acid, sebacic acid, azelaic acid, octadecanedicarboxylic acid, octadecanedicarboxylic acid, decylsuccinic acid; alkenylsuccinic acids such as dodecenylsuccinic acid, pentadecenylsuccinic acid and octadecenylsuccinic acid; alkenedicarboxylic acids having 4 to 36 carbon atoms such as maleic acid, fumaric acid and citraconic acid; and alicyclic dicarboxylic acids having 6 to 40 carbon atoms such as dimer acid (dimerized linoleic acid).

The aromatic dicarboxylic acid is not particularly restricted and may be appropriately selected according to purpose. Favorable examples thereof include an aromatic dicarboxylic acid having 8 to 36 carbon atoms such as phthalic acid, isophthalic acid, terephthalic acid, t-butyl and isophthalic acid, 2,6-naphthalene dicarboxylic acid, and 4,4'-biphenyldicarboxylic acid.

Also, examples of the polycarboxylic acid having 3 to 6 or higher valences used according to necessity include an aromatic polycarboxylic acid trimellitic acid having 9 to 20 carbon atoms such as pyromellitic acid.

Here, as the dicarboxylic acid or the polycarboxylic acid having 3 to 6 or higher valences, an acid anhydride or a lower alkyl ester having 1 to 4 carbon atoms (methyl ester, ethyl ester and isopropyl ester, etc.) of the above may be used.

Among the dicarboxylic acid, it is particularly preferable to use the aliphatic dicarboxylic acid (preferably, adipic acid, sebacic acid, octadecanedicarboxylic acid, terephthalic acid, and isophthalic acid, etc.) alone, but use of a copolymer of the aliphatic dicarboxylic acid along with the aromatic dicarboxylic acid (preferably, terephthalic acid, and isophthalic acid, t-butyl and isophthalic acid, etc.; lower alkyl esters of these aromatic dicarboxylic acids) is similarly preferable. An amount of copolymerization of the aromatic dicarboxylic acid is not particularly restricted and may be appropriately selected according to purpose. Nonetheless, 20% by mole or less is preferable.

—Lactone Ring-Opening Polymerization Product—

The lactone ring-opening polymerization product is not particularly restricted and may be appropriately selected according to purpose. Examples thereof include a lactone ring-opening polymerization product obtained by ring-opening polymerization of lactones, e.g. monolactones (having one ester group in the ring) having 3 to 12 carbon atoms such as β-propiolactone, γ-butyrolactone, δ-valerolactone, ϵ-caprolactone using a catalyst such as metal oxide and organic metal compound; a lactone ring-opening polymerization product having a hydroxyl group at an end thereof obtained by ring-opening polymerization of the monolactones having 3 to 12 carbon atoms with a glycol (e.g. ethylene glycol, diethylene glycol) as an initiator.

The monolactone having 3 to 12 carbon atoms is not particularly restricted and may be appropriately selected according to purpose. Nonetheless, ϵ-caprolactone is preferable in view of crystallinity.

Also, as the lactone ring-opening polymerization product, commercially available products may be used; examples of the commercially available products include a highly crystalline polycaprolactone such as H1P, H4, H5, H7 of PLACCEL series manufactured by Daicel Corporation.

—Polyhydroxy Carboxylic Acid—

A method for preparing the polyhydroxy carboxylic acid is not particularly restricted and may be appropriately selected according to purpose. Examples thereof include: direct dehydration polycondensation of a hydroxycarboxylic acid such as glycolic acid and lactic acid (L-form, D-form, racemic form, etc.); and ring-opening polymerization of a cyclic ester having 4 to 12 carbon atoms (2 to 3 ester groups in the ring) corresponding to a dehydration condensation product between 2 molecules or 3 molecules of hydroxycarboxylic acid such as glycolide and lactide (L-form, D-form, racemic form, etc.) using a catalyst such as metal oxide and organic metal compound. The ring-opening polymerization is preferable in view of adjusting the molecular weight.

Among the cyclic ester, in view of crystallinity, L-lactide and D-lactide are preferable. Also, the polyhydroxy carboxylic acid may be modified such that an end thereof has a hydroxyl group or a carboxyl group.

The crystalline polyester is modified crystalline polyester having a urethane and/or a urea group skeleton with an end thereof isocyanate-modified and bound with amines or polyols.

As the isocyanate component used in the modified crystalline polyester, as a diisocyanate, an aromatic diisocyanate having 6 to 20 carbon atoms (excluding the carbon atom in the NCO group, hereinafter the same), an aliphatic diisocyanate having 2 to 18 carbon atoms, an alicyclic diisocyanate having 4 to 15 carbon atoms, an aromatic aliphatic diisocyanate having 8 to 15 carbon atoms, and a modified product of these diisocyanates (e.g. a modified product including a urethane group, a carbodiimide group, an allophanate group, a urea group, a biuret group, a uretdione group, a uretoimin group, an isocyanurate group, and an oxazolidone group); and a mixture of two or more of these.

Also, according to necessity, a polyisocyanate having 3 or more valences may be used in combination.

Specific examples of the aromatic diisocyanate (including the polyisocyanate having 3 or more valences) include: 1,3- and/or 1,4-phenylene diisocyanate, 2,4- and/or 2,6-tolylene diisocyanate (TDI), crude TDI, 2,4'- and/or 4,4'-diphenylmethane diisocyanate (MDI), crude MDI [phosgene compound of crude diaminophenylmethane [condensation product of formaldehyde and aromatic amine (aniline) or a mixture thereof, mixture of diaminodiphenylmethane and a small amount (5% by mass to 20% by mass, for example) of a polyamine having three or more functional groups]: polyallyl polyisocyanate (PAPI)], 1,5-naphthylene diisocyanate, 4,4',4"-triphenylmethane diisocyanate, and m- and p-isocyanatophenyl sulfonyl isocyanate.

Specific examples of the aromatic diisocyanate (including the polyisocyanate having 3 or more valences) include: ethylene diisocyanate, tetramethylene diisocyanate, hexamethylene diisocyanate (HDI), dodecamethylene diisocyanate, 1,6,11-undecane triisocyanate, 2,2,4-trimethylhexamethylene diisocyanate, lysine diisocyanate, 2,6-diisocyanatomethyl caproate, bis(2-isocyanatoethyl)fumarate, bis(2-isocyanatoethyl)carbonate, and 2-isocyanatoethyl-2,6-diisocyanato hexanoate.

Specific examples of the alicyclic diisocyanate include isophorone diisocyanate (IPDI), dicyclohexylmethane-4,4'-diisocyanate (hydrogenated MDI), cyclohexylene diisocyanate, methyl cyclohexylene diisocyanate (hydrogenated TDI), bis(2-isocyanatoethyl)-4-cyclohexene-1,2-dicarboxylate, and 2,5- and/or 2,6-norbornane diisocyanate.

Specific examples of the aromatic aliphatic diisocyanate include m- and/or p-xylylene diisocyanate (XDI) and α,α,α',α'-tetramethylxylylene diisocyanate (TIMXDI).

Also, examples of the modified product of a diisocyanate include a modified product including a urethane group, a carbodiimide group, an allophanate group, a urea group, a biuret group, a uretdione group, a uretoimin group, an isocyanurate group, and an oxazolidone group.

Specifically, a mixture of two or more of a modified MDI (urethane-modified MDI, a carbodiimide-modified MDI, and a trihydrocarbyl phosphate-modified MDI), a diisocyanate modified product such as urethane-modified TDI, a mixture of two or more thereof [e.g. a combination of the modified MDI and a urethane-modified TDI (prepolymer including isocyanate)].

Among these, the aromatic diisocyanate having 6 to 15 carbon atoms, the aliphatic diisocyanate having 4 to 12 carbon atoms, and the alicyclic diisocyanate having 4 to 15 carbon atoms are preferable, and TDI, MDI, HDI, hydrogenated MDI, and IPDI are particularly preferable.

As the hardening agent, a conventionally known amine compound may be favorably used.

Examples of the diamine (including a polyamine having 3 or more valences used according to necessity) include: as the aliphatic diamines (C2 to C18), [1] aliphatic diamine (C2 to C6 alkylene diamine (ethylene diamine, propylene diamine, trimethylene diamine, tetramethylene diamine, hexamethylene diamine, etc.), polyalkylene (C2 to C6) diamine [diethylene triamine, iminobispropylamine, bis(hexamethylene) triamine, triethylene tetramine, tetraethylene pentamine, pentaethylene hexamine, etc.]); [2] alkyl (C1 to C4) or hydroxyalkyl (C2 to C4) substitution product thereof [dialkyl (C1 to C3) aminopropylamine, trimethylhexamethylene diamine, aminoethylethanolamine, 2,5-dimethyl-2,5-hexamethylene diamine, methyliminobispropylamine, etc]; [3] alicyclic or heterocyclic ring-containing aliphatic diamine (alicyclic diamine (C4 to C15) [1,3-d]aminocyclohexane, isophorone diamine, menthenediamine, 4,4'-methylene methylenedichylohexanediamine(hydrogenated methylene dianiline) etc.], alicyclic diamine (C4 to C15) [piperazine, N-aminoethylpiperazine, 1,4-diaminoethylpiperazine, 1,4-bis(2-amino-2-methylpropyl)piperazine, 3,9-bis(3-aminopropyl)-2,4,8,10-tetra tetraoxaspiro[5,5]undecane, etc.]; [4] aromatic ring-containing aliphatic amines (C8 to C15) (xylylenediamine, tetrachloro-p-xylylenediamine, etc.).

Examples of the aromatic diamines (C6 to C20) include:

[1]: non-substituted aromatic diamines [1,2-, 1,3- and 1,4-phenylenediamine, 2,4'- and 4,4'-diphenylmethanediamine, crude diphenylmethanediamine(polyphenylpolymethylenepolyamine), diaminodiphenyl sulfone, benzidine, thiodianiline, bis(3,4-di-aminophenyl)sulfone, 2,6-diaminopyridine, m-aminobenzylamine, triphenylmethane-4,4',4"-triamine and naphthylenediamine;

[2]: aromatic diamines having nuclear-substituted alkyl group [C1 to C4 alkyl group such as methyl, ethyl, n- and i-propyl, and butyl groups], including, 2,4- and 2,6-triethylenediamine, crude tolylenediamme, diethyltolylenediamine, 4,4'-diamino-3,3'-dimethyldiphenylmethane, 4,4'-bis(o-toluidine), dianisidine, diaminoditolyl sulfone, 1,3-dimethyl-2,4-diaminobenzene, 1,3-dimethyl-2,6-diaminobenzene, 1,4-diisopropyl-2,5-diaminobenzene, 2,4-diaminomesitylene, 1-methyl-3,5-diethyl-2,4-diaminobenzene, 2,3-dimethyl-1,4-diaminonaphthalene, 2,6-dimethyl-1,5-diaminonaphthalene, 3,3',5,5'-tetramethylbenzidine, 3,3',5,5'-tetramethyl-4,4'-diaminodiphenylmethane, 3,5-diethyl-3'-methyl-2',4-diaminodiphenylmethane, 3,3'-diethyl-2,2'-diaminodiphenylmethane, 4,4'-diamino-3,3'-dimethyldiphenylmethane, 3,3',5,5'-tetraethyl-4,4'-diaminobenzophenone, 3,3',5,5'-tetraethyl-4,4'-diamino diphenyl ether and 3,3',5,5'-tetraisopropyl-4,4'-diaminodiphenyl sulfone, etc.], and a mixture of various ratios of the unsubstituted aromatic diamines or isomers;

[3]: aromatic diamines having nuclear substituted electron-withdrawing group (for example, halogens such as Cl, Br, I and F; alkoxy group such as methoxy and ethoxy groups; and nitro group) [methylenebis-o-chloroaniline, 4-chloro-o-phenylenediamine, 2-chloro-1,4-phenylenediamine, 3-amino-4-chloroaniline, 4-bromo-1,3-phenylenediamine, 2,5-dichloro-1,4-phenylenediamine, 5-nitro-1,3-phenylenediamine and 3-dimethoxy-4-aminoaniline; 4,4'-diamino-3,3'-dimethyl-5,5'-dibromodiphenylmethane, 3,3'-dichlorobenzidine, 3,3'-dimethoxybenzidine, bis(4-amino-3-chlorophenyl)oxide, bis(4-amino-2-chlorophenyl)propane, bis(4-amino-2-chlorophenyl)sulfone, bis(4-amino-3-methoxyphenyl)decane, bis(4-aminophenyl) sulfide, bis(4-aminophenyl)telluride, bis(4-aminophenyl) selenide, bis(4-amino-3-methoxyphenyl)disulfide, 4,4'-methylenebis(2-iodoaniline), 4,4'-methylenebis(2-bromoaniline), 4,4'-methylenebis(2-fluoroaniline) and 4-aminophenyl-2-chloroaniline];

[4]: aromatic diamines having a secondary amino group [a part or all the —$NH_2$ group in the aromatic diamine of [1] to [3] above is replaced by —NH—R' (where R' is an alkyl group, e.g. a lower alkyl group such as methyl and ethyl groups][4,4'-di(methylamino)diphenylmethane, 1-methyl-2-methylamino-4-aminobenzene, etc.].

Other examples of the diamines include: polyamide polyamines [e.g. low-molecular polyamide polyamine obtained by condensation of a dicarboxylic acid (e.g. dimer acid) with an excess amount (e.g. 2 moles or greater per 1 mole of the acid) of the polyamine (e.g. the alkylenediamine and the polyalkylenepolyamine)], a polyether polyamine [e.g. hydrate of cyanoethylated polyether polyol (e.g. polyalkylene glycol)].

<<Determination of Crystallinity>>

Crystallinity of the crystalline polyester resin of the present invention may be determined by the following method.

Presence or absence of crystallinity may be confirmed by a crystal analysis x-ray diffractometer (X'PERT PRO MRD, manufactured by Philips). A measurement method is described below.

First, a target sample is ground by a mortar to prepare a sample powder. The obtained sample powder is uniformly coated on a sample holder. Thereafter, the sample was set up in a diffraction apparatus, a measurement is conducted, and a diffraction spectrum is obtained.

The sample is determined to having crystallinity when a peak having the largest peak intensity among the peaks obtained in a range of $20° < 2\theta < 25°$ of the obtained diffraction peak has a peak half width of 2.0 or less.

Measurement conditions of the x-ray diffraction are described below.

[Measurement Conditions]

Tension kV: 45 kV

Current: 40 mA

MPSS

Upper

Gonio
Scanmode: continuos
Start angle: 3°
End angle: 35°
Angle Step: 0.02°
Lucident beam optics
Divergence slit: Div slit 1/2
Difflection beam optics
Anti scatter slit: As Fixed 1/2
Receiving slit: Prog rec slit <Non-Crystalline Polyester Resin>

The non-crystalline polyester resin is obtained by using a polyhydric alcohol component and a polycarboxylic acid component such as polycarboxylic acid, polycarboxylic acid anhydride and polycarboxylic acid ester.

Here, in the present invention, the non-crystalline polyester resin denotes a resin obtained by using a polyhydric alcohol component and a polycarboxylic acid component such as polycarboxylic acid, polycarboxylic acid anhydride and polycarboxylic acid ester as above, and modifications of a polyester resin, for example, resins obtained from a prepolymer described hereinafter or obtained by crosslinking and/or elongation reaction of the prepolymer, do not belong to the non-crystalline polyester resin.

Examples of the polyhydric alcohol component include: alkylene (2 to 3 carbon atoms) oxide (with an average addition of 1 to 10 moles) adducts such as polyoxypropylene(2.2)-2,2-bis(4-hydroxyphenyl)propane and polyoxyethylene (2.2)-2,2-bis(4-hydroxyphenyl)propane of bisphenol A; and ethylene glycol, propylene glycol, neopentyl glycol, glycerin, pentaerythritol, trimethylolpropane, hydrogenated bisphenol A, sorbitol, or an alkylene (2 to 3 carbon atoms) oxide (with an average addition of 1 to 10 moles) adduct thereof. These may be used alone or in combination of two or more.

Examples of the polycarboxylic acid component include: dicarboxylic acids such as adipic acid, phthalic acid, and isophthalic acid, terephthalic acid, fumaric acid and maleic acid; succinic acids substituted by an alkyl group having 1 to 20 carbon atoms or an alkenyl group having 2 to 20 carbon atoms such as dodecenylsuccinic acid and octylsuccinic acid; trimellitic acid, pyromellitic acid; anhydrides of these acids and an alkyl (1 to 8 carbon atoms) ester of these acids. These may be used alone or in combination of two or more.

It is preferable that the non-crystalline polyester resin, a prepolymer described hereinafter and a resin obtained by subjecting this prepolymer to a crosslinking and/or an elongation reaction are at least partially compatible. With these being compatible, low-temperature fixing property and high temperature-resistant offset property may be improved. Thus, it is preferable that the polyhydric alcohol component and the polycarboxylic acid component which constitute the non-crystalline polyester resin and a polyhydric alcohol component and polycarboxylic acid component which constitute the prepolymer described hereinafter have a similar composition.

A molecular weight of the non-crystalline polyester resin is not particularly restricted and may be appropriately selected according to purpose. Nonetheless, when the molecular weight is too low, heat-resistant storage stability of the toner and durability to stresses such as stirring in a developing device may be inferior. When the molecular weight is too high, viscoelasticity of the toner during melting increases and low-temperature fixing property may be inferior.

Although they are not particularly restricted and may be appropriately selected according to purpose, based on above, a weight-average molecular weight (Mw) is preferably 3,000 to 15,000, a number-average molecular weight (Mn) is preferably 1,000 to 5,000, and Mw/Mn is preferably 1.0 to 4.0.

Further, the weight-average molecular weight (Mw) is preferably 5,000 to 15,000, the number-average molecular weight (Mn) is preferably 1,500 to 5,000, and Mw/Mn is preferably 1.0 to 3.5.

An acid value of the non-crystalline polyester resin is not particularly restricted and may be appropriately selected according to purpose. Nonetheless, it is preferably 1 mgKOH/g to 50 mgKOH/g, and more preferably 5 mgKOH/g to 30 mgKOH/g. When the acid value is 1 mgKOH/g or greater, the toner is likely to be negatively charged. Further compatibility between paper and the toner improves during fixing on the paper, and low-temperature fixing property may be improved. When the acid value exceeds 50 mgKOH/g, charge stability, especially charge stability against environmental variation, may decrease.

A hydroxyl value of the non-crystalline polyester resin is not particularly restricted and may be appropriately selected according to purpose. Nonetheless, it is preferably 5 mgKOH/g or greater.

A glass transition temperature (Tg) of the non-crystalline polyester resin is not particularly restricted and may be appropriately selected according to purpose. When the Tg is too low, heat-resistant storage stability of the toner and durability to stresses such as stirring in a developing device may be inferior. When the Tg is too high, viscoelasticity of the toner during melting increases and low-temperature fixing property may be inferior. Accordingly, it is preferably 20° C. to 60° C., and more preferably 30° C. to 50° C.

A content of the non-crystalline polyester resin is not particularly restricted and may be appropriately selected according to purpose. Nonetheless, it is preferably 50% by mass or greater in the toner, and it is more preferably 60% by mass or greater and less than 90% by mass.

When the content is less than 50% by mass, dispersibility of the various materials that are present in a dispersed state in the toner such as modified crystalline polyester, pigment and releasing agent degrades, and degradation of low-temperature fixing property and heat-resistant storage stability as well as fogging or disturbance of an image may occur. The content in the more preferable range is advantageous, since image quality, stability, low-temperature fixing property, and high-temperature and high-humidity resistance are all superior.

Here, the content of the non-crystalline polyester resin in the toner may be obtained from a composition of materials in manufacturing the toner. Also, when the composition of the materials in manufacturing the toner is not clear, the content of the non-crystalline polyester resin of the present invention may be obtained by the following method, for example. A toner dissolution liquid is obtained by stirring sufficiently 50 parts by mass of the toner and 50 parts by mass of methyl ethyl ketone at 23° C. for 1 hour with a magnetic stirrer. The obtained toner dissolution liquid is filtered by a membrane filter. A filtrate is heated at 150° C. for 1 hour, and a solid content concentration in the filtrate is calculated from the weight change before and after heating. The obtained solid content of the filtrate is the content of the non-crystalline polyester resin.

A molecular structure of the non-crystalline polyester resin may be confirmed by, other than an NMR (Nuclear Magnetic Resonance) measurement with a solution or a solid, an x-ray diffraction, a GC/MS (Gas Chromatograph Mass Spectrometer), an LC/MS Liquid Chromatograph Mass Spectrometer) or an IR (Infrared Spectroscopy) measurement. Conveniently, in the infrared absorption spectrum, a spectrum which does not have an absorption based on δCH (out-ofplane bending vibration) of an olefin at 965±10 $cm^{-1}$ and 990±10 $cm^{-1}$ is detected as the non-crystalline polyester resin.

<Releasing Agent>

The releasing agent is not particularly restricted and may be appropriately selected from heretofore known ones.

Examples of waxes as the releasing agent include natural waxes including: vegetable waxes such as carnauba wax, cotton wax, Japan wax and rice wax; animal waxes such as bees wax and lanolin; mineral waxes such as ozokerite and ceresin; and petroleum waxes such as paraffin, microcrystalline wax and petrolatum.

Also, other than these natural waxes, examples of the waxes include synthetic waxes including: synthetic hydrocarbon waxes such as Fischer-Tropsch wax, polyethylene and polypropylene; and esters, ketones and ethers.

Further examples include: fatty acid amide compounds such as 12-hydroxystearic amide, stearic amide, phthalic anhydride imide and chlorinated hydrocarbons; homopolymers or copolymers of polyacrylates such as poly-n-stearyl methacrylate and poly-n-lauryl methacrylate as a low-molecular weight crystalline polymeric resin (e.g. a copolymer of n-stearylacrylate-ethyl methacrylate); and a crystalline polymer having a long alkyl group in a side chain.

Among these, hydrocarbon waxes such as paraffin wax, microcrystalline wax, Fischer-Tropsch wax, polyethylene wax and polypropylene wax are preferable.

A melting point of the releasing agent is not particularly restricted and may be appropriately selected according to purpose. Nonetheless, it is preferably 60° C. or greater and less than 95° C.

The releasing agent is not particularly restricted and may be appropriately selected according to purpose. Nonetheless, it is preferably a hydrocarbon wax having a melting point of 60° C. or greater and less than 95° C. Such a releasing agent may effectively act as a releasing agent between a fixing roller and a toner interface, and high temperature-resistant offset property may be improved even though a releasing agent such as oil is not applied on the fixing roller.

In particular, the hydrocarbon wax is hardly compatible with the crystalline polyester resin, and they function independently, which is preferable because a softening effect of the crystalline polyester resin as a binder resin and offset property of the releasing agent are not impaired.

When the melting point of the releasing agent is less than 60° C., the releasing agent is likely to melt at a low temperature, and heat-resistant storage stability of the toner may be inferior. When the melting point of the releasing agent is 95° C. or greater, the releasing agent does not melt sufficiently by heating during fixing, and sufficient offset property may not be obtained.

A content of the releasing agent is not particularly restricted and may be appropriately selected according to purpose. Nonetheless, it is preferably 2% by mass to 10% by mass in the toner, and more preferably 3% by mass to 8% by mass. When the content is less than 2% by mass, high temperature-resistant offset property and low-temperature fixing property during fixing may be inferior. When it exceeds 10% by mass, heat-resistant storage stability may degrade, and fogging of an image is likely to occur. The content within the more preferable range is advantageous in terms of improved high-quality image and fixing stability.

<Colorant>

The colorant is not particularly restricted and may be appropriately selected according to purpose. Examples thereof include: carbon black, nigrosine dye, iron black, naphthol yellow S, Hansa Yellow (10G, 5G, G), cadmium yellow, yellow iron oxide, yellow ocher, chrome yellow, titanium yellow, polyazo yellow, Oil Yellow, Hansa Yellow (GR, A, RN, R), Pigment Yellow L, Benzidine Yellow (G, GR), Permanent Yellow (NCG) (NCG), Vulcan Fast Yellow (5G, R), tartrazine lake, quinoline yellow lake, Anthrazane Yellow BGL, isoindolinone yellow, colcothar, red lead, lead vermilion, cadmium red, Cadmium Mercury Red, antimony vermilion, Permanent Red 4R, Para Red, fiser red, para-chloro-ortho-nitro aniline red, Lithol Fast Scarlet G, Brilliant Fast Scarlet, Brilliant Carmine BS, Permanent Red (F2R, F4R, FRL, FRLL, F4RH), Fast Scarlet VD, Vulcan Fast Rubin B, Brilliant Scarlet G, Lithol Rubin GX, Permanent Red F5R, Brilliant Carmine 6B, Pigment Scarlet 3B, Bordeaux 5B, Toluidine Maroon, Permanent Bordeaux F2K, Helio Bordeaux BL, Bordeaux 10B, BON Maroon Light, BON Maroon Medium, Eosin Lake, Rhodamine Lake B, Rhodamine Lake Y, Alizarine Lake, Thioindigo Red B, Thioindigo Maroon, Oil Red, Quinacridone Red, Pyrazolone Red, polyazo red, Chrome Vermilion, Benzidine Orange, perynone orange, Oil Orange, cobalt blue, cerulean blue, Alkali Blue Lake, Peacock Blue Lake, Victoria Blue Lake, metal-free Phthalocyanine Blue, Phthalocyanine Blue, Fast Sky Blue, Indanthrene Blue (RS, BC), Indigo, ultramarine, Prussian blue, Anthraquinone Blue, Fast Violet B, Methyl Violet Lake, cobalt violet, manganese violet, dioxane violet, Anthraquinone Violet, Chrome Green, zinc green, chromium oxide, viridian, emerald green, Pigment Green B, Naphthol Green B, Green Gold, Acid Green Lake, Malachite Green Lake, phthalocyanine green, anthraquinone green, titanium oxide, zinc oxide, and lithopone.

A content of the colorant is not particularly restricted and may be appropriately selected according to purpose. Nonetheless, it is preferably 1% by mass to 15% by mass, and more preferably 3% by mass to 10% by mass in the toner.

The colorant may be used as it is along with the other toner raw materials, or it may be combined with a resin and used as a masterbatch. Examples of the resin used in manufacturing the masterbatch or kneaded with the masterbatch include, other than the non-crystalline polyester resin: a polymer of styrene or substituent thereof such as polystyrene, poly-p-chlorostyrene and polyvinyltoluene; a styrene copolymer such as styrene-p-chlorostyrene copolymer, styrene-propylene copolymer, styrene-vinyltoluene copolymer, styrene-vinylnaphthalene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-α-methyl chloromethacrylate copolymer, styrene-acrylonitrile copolymer, styrene-vinyl methyl ketone copolymer, styrene-butadiene copolymer, styrene-isoprene copolymer, styrene-acrylonitrile-indene copolymer, styrene-maleic acid copolymer and styrene-maleic acid ester copolymer; and polymethyl methacrylate, polybutyl methacrylate, polyvinyl chloride, polyvinyl acetate, polyethylene, polypropylene, polyester, epoxy resin, epoxy polyol resin, polyurethane, polyamide, polyvinyl butyral, polyacrylic acid, rosin, modified rosin, terpene resin, aliphatic or alicyclic hydrocarbon resin, aromatic petroleum resin, chlorinated paraffin, and paraffin wax. These may be used alone or in combination of two or more.

The masterbatch may be obtained by mixing and kneading the resin for a masterbatch and the colorant with an application of high shear force. Here, in order to enhance an interaction between the colorant and the resin, an organic solvent may be used. Also, a so-called flushing method is favorable since a wet cake of the colorant may be used as it is, without necessity of drying. The flushing method is a method of mixing and kneading an aqueous paste of the colorant including water with a resin and an organic medium to remove the water and the organic medium by transferring the colorant to the resin. For mixing or kneading, for example, a high shear dispersing apparatus such as three-roll mill may be used.

<Other Component>

The other component is not particularly restricted and may be appropriately selected according to purpose. Examples thereof include a polymer having a portion capable of reacting with the compound having an active hydrogen group, a compound having an active hydrogen group, a charge controlling agent, an external additive, a fluidity improving agent, a cleanability improving agent, and a magnetic material.

—Polymer Having a Portion Capable of Reacting with the Compound Having an Active Hydrogen Group (Prepolymer)—

The polymer having a portion capable of reacting with the compound having an active hydrogen group (may also be referred to as "prepolymer") is not particularly restricted and may be appropriately selected according to purpose. Examples thereof include a polyol resin, a polyacrylic resin, a polyester resin, an epoxy resin, and a derivative thereof. These may be used alone or in combination of two or more.

Among these, in view of high fluidity and transparency in melting, the polyester resin is preferable.

Examples of the portion capable of reacting with the compound having an active hydrogen group in the prepolymer include an isocyanate group, an epoxy group, a carboxyl group and a functional group denoted as —COCl. These may be used alone or in combination of two or more.

Among these, the isocyanate group is preferable.

The prepolymer is not particularly restricted and may be appropriately selected according to purpose. Nonetheless, a polyester resin having an isocyanate group, etc. which may generate a urea bond is preferable since it enables easy adjustment of a molecular weight of a high-molecular component and is possible to ensure oil-less low-temperature fixing property, and especially favorable releasing property and fixability even without a releasing oil coating mechanism to a heating medium for fixing in a dry toner.

—Polyester Resin Having Isocyanate Group—

The polyester resin having an isocyanate group (hereinafter, may also be referred to as a "polyester prepolymer having an isocyanate group") is not particularly restricted and may be appropriately selected according to purpose. Examples thereof include a reaction product of: a polyester resin having an active hydrogen group obtained by polycondensation of polyol and polycarboxylic acid; and polyisocyanate.

—Polyol—

The polyol is not particularly restricted and may be appropriately selected according to purpose. Examples thereof include a diol, an alcohol having 3 or more valences, and a mixture of a diol and an alcohol having 3 or more valences. These may be used alone or in combination of two or more.

Among these, a diol, and a mixture of a diol with a small amount of an alcohol having 3 or more valences is preferable.

The diol is not particularly restricted and may be appropriately selected according to purpose. Examples thereof include: alkylene glycols such as ethylene glycol, 1,2-propylene glycol, 1,3-propylene glycol, 1,4-butanediol, and 1,6-hexanediol; diols having an oxyalkylene group such as diethylene glycol, triethylene glycol, dipropylene glycol, polyethylene glycol, polypropylene glycol, polytetramethylene glycol; alicyclic diols such as 1,4-cyclohexane dimethanol and hydrogenated bisphenol A; adducts of an alicyclic diol with an alkylene oxide such as ethylene oxide, propylene oxide and butylene oxide; bisphenols such as bisphenol A, bisphenol F, bisphenol S; and alkylene oxide adducts of bisphenols that an alkylene oxide such as ethylene oxide, propylene oxide and butylene oxide are added to bisphenols. Here, a number of carbon atoms in the alkylene glycol is not particularly restricted and may be appropriately selected according to purpose. Nonetheless, it is preferably 2 to 12.

Among these, an alkylene glycol having 2 to 12 carbon atoms and an alkylene oxide adduct of bisphenols are preferable, and the alkylene oxide adduct of bisphenols, and a mixture of the alkylene oxide adduct of bisphenols and the alkylene glycol having 2 to 12 carbon atoms are more preferable.

The alcohol having 3 or more valences is not particularly restricted and may be appropriately selected according to purpose. Examples thereof include aliphatic alcohols having 3 or more valences, polyphenols having 3 or more valences, and alkylene oxide adducts of polyphenols having 3 or more valences.

The aliphatic alcohols having 3 or more valences are not particularly restricted and may be appropriately selected according to purpose. Examples thereof include glycerin, trimethylolethane, trimethylolpropane, pentaerythritol, and sorbitol.

The polyphenols having 3 or more valences are not particularly restricted and may be appropriately selected according to purpose. Examples thereof include trisphenol PA, phenol novolak, and cresol novolak.

Examples of the alkylene oxide adduct of polyphenols having 3 or more valences include polyphenols having 3 or more valences added with an alkylene oxide such as ethylene oxide, propylene oxide and butylene oxide.

When a mixture of the diol and the alcohol having 3 or more valences is used, a mass ratio of the alcohol having 3 or more valences with respect to the diol is not particularly restricted and may be appropriately selected according to purpose. Nonetheless, it is preferably 0.01% by mass to 10% by mass, and more preferably 0.01% by mass to 1% by mass.

—Polycarboxylic Acid—

The polycarboxylic acid is not particularly restricted and may be appropriately selected according to purpose. Examples thereof include a dicarboxylic acid, a carboxylic acid having 3 or more valences, and a mixture of a dicarboxylic acid and a carboxylic acid having 3 or more valences. These may be used alone or in combination of two or more.

Among these, the dicarboxylic acid and a mixture of a dicarboxylic acid with a small amount of a polycarboxylic acid are preferable.

The dicarboxylic acid having 3 or more valences is not particularly restricted and may be appropriately selected according to purpose. Examples thereof include a divalent alkanoic acid, a divalent alkene acid and an aromatic dicarboxylic acid.

The divalent alkanoic acid is not particularly restricted and may be appropriately selected according to purpose. Examples thereof include succinic acid, adipic acid, and sebacic acid.

The divalent alkene acid is not particularly restricted and may be appropriately selected according to purpose. Nonetheless, a divalent alkene acid having 4 to 20 carbon atoms is preferable. The divalent alkene acid having 4 to 20 carbon atoms is not particularly restricted and may be appropriately selected according to purpose. Examples thereof include maleic acid and fumaric acid.

The aromatic dicarboxylic acid is not particularly restricted and may be appropriately selected according to purpose. Nonetheless, an aromatic dicarboxylic acid having 8 to 20 carbon atoms is preferable. The aromatic dicarboxylic acid having 8 to 20 carbon atoms is not particularly restricted and may be appropriately selected according to purpose. Examples thereof include phthalic acid, isophthalic acid, terephthalic acid, and naphthalenedicarboxylic acid.

The carboxylic acid having 3 or more valences is not particularly restricted and may be appropriately selected according to purpose. Examples thereof include an aromatic carboxylic acid having 3 or more valences.

The aromatic carboxylic acid having 3 or more valences is not particularly restricted and may be appropriately selected according to purpose. Nonetheless, aromatic carboxylic acid having 9 to 20 carbon atoms is preferable. The aromatic carboxylic acid having 3 or more valences and having 9 to 20 carbon atoms is not particularly restricted and may be appropriately selected according to purpose. Examples thereof include trimellitic acid and pyromellitic acid.

As the polycarboxylic acid, an acid anhydride or a lower alkyl ester of the dicarboxylic acid, the carboxylic acid having 3 or more valences, or the mixture of a dicarboxylic acid and a carboxylic acid may be used.

The lower alkyl ester is not particularly restricted and may be appropriately selected according to purpose. Examples thereof include a methyl ester, an ethyl ester and an isopropyl ester.

When a mixture of the dicarboxylic acid and the carboxylic acid having 3 or more valences is used, a mass ratio of the carboxylic acid having 3 or more valences with respect to the dicarboxylic acid is not particularly restricted and may be appropriately selected according to purpose. Nonetheless, it is preferably 0.01% by mass to 10% by mass, and more preferably 0.01% by mass to 1% by mass.

When the polyol and the polycarboxylic acid are subjected to polycondensation, an equivalent ratio of hydroxyl groups in the polyol with respect to carboxyl group in the polycarboxylic acid is not particularly restricted and may be appropriately selected according to purpose. Nonetheless, it is preferably 1 to 2, more preferably 1 to 1.5, and particularly preferably 1.02 to 1.3.

A content a structural unit derived from the polyol in the polyester prepolymer having an isocyanate group is not particularly restricted and may be appropriately selected according to purpose. Nonetheless, it is preferably 0.5% by mass to 40% by mass, more preferably 1% by mass to 30% by mass, and particularly preferably 2% by mass to 20% by mass.

When the content is less than 0.5% by mass, high temperature-resistant offset property decreases, and it becomes difficult to achieve both heat-resistant storage stability and low-temperature fixing property of the toner. When it exceeds 40% by mass, low-temperature fixing property may decrease.

—Polyisocyanate—

The polyisocyanate is not particularly restricted and may be appropriately selected according to purpose. Examples thereof include an aliphatic diisocyanate, an alicyclic diisocyanate, an aromatic diisocyanate, an aromatic aliphatic diisocyanate, isocyanurates, and those blocked by a phenol derivative, oxime or caprolactum.

The aliphatic diisocyanate is not particularly restricted and may be appropriately selected according to purpose. Examples thereof include tetramethylene diisocyanate, hexamethylene diisocyanate, 2,6-diisocyanatocaproic acid methyl ester, octamethylene diisocyanate, decamethylene diisocyanate, dodecamethylene diisocyanate, tetradecamethylene diisocyanate, trimethylhexane diisocyanate, and tetramethylhexane diisocyanate.

The alicyclic diisocyanate is not particularly restricted and may be appropriately selected according to purpose. Examples thereof include isophorone diisocyanate, and cyclohexyl diisocyanate.

The aromatic diisocyanate is not particularly restricted and may be appropriately selected according to purpose. Examples thereof include tolylene diisocyanate, diisocyanatodiphenylmethane, 1,5-1,5-naphthylene diisocyanate, 4,4'-diisocyanatodiphenyl, 4,4'-diisocyanato-3,3'-dimethyldiphenyl, 4,4'-diisocyanato-3-methyldiphenylmethane, and 4,4'-diisocyanato-diphenyl ether.

The aromatic aliphatic diisocyanate is not particularly restricted and may be appropriately selected according to purpose. Examples thereof include $\alpha,\alpha,\alpha',\alpha'$-tetramethylxylylene diisocyanate.

The isocyanurates are not particularly restricted and may be appropriately selected according to purpose. Examples thereof include tris(isocyanatoalkyl)isocyanurate, and tris (isocyanatocycloalkyl)isocyanurate. These may be used alone or in combination of two or more.

When the polyisocyanate is reacted with a polyester resin having a hydroxyl group, an equivalent ratio of the isocyanate group in the polyisocyanate with respect to hydroxyl group in the polyester resin is not particularly restricted and may be appropriately selected according to purpose. Nonetheless, it is preferably 1 to 5, more preferably 1.2 to 4, and particularly preferably 1.5 to 3. When the equivalent ratio is less than 1, offset resistance may decrease. When it exceeds 5, low-temperature fixing property may decrease.

A content of a structural unit derived from the polyisocyanate in the polyester prepolymer having an isocyanate group is not particularly restricted and may be appropriately selected according to purpose. Nonetheless, it is preferably 0.5% by mass to 40% by mass, more preferably 1% by mass to 30% by mass, and particularly preferably 2 to 20% by mass. When the content is less than 0.5% by mass, high temperature-resistant offset property may decrease. When it exceeds 40% by mass, low-temperature fixing property may decrease.

An average number of isocyanate groups per one molecule of the polyester prepolymer having an isocyanate group is not particularly restricted and may be appropriately selected according to purpose. Nonetheless, it is preferably 1 or greater, more preferably 1.2 to 5, and particularly preferably 1.5 to 4. When the average number is less than 1, a molecular weight of the urea-modified polyester resin decreases, and high temperature-resistant offset property may decrease.

A mass ratio of the polyester prepolymer having an isocyanate group with respect to the whole mass of the toner is not particularly restricted and may be appropriately selected according to purpose. Nonetheless, it is preferably 5/95 to 25/75, and more preferably 10/90 to 25/75. When the mass ratio is less than 5/95, high temperature-resistant offset property may degrade. When it exceeds 25/75, low-temperature fixing property or gloss of an image may decrease.

—Compound Having Active Hydrogen Group—

The compound having an active hydrogen group acts as an elongation agent or a crosslinking agent in an elongation reaction or a crosslinking reaction of the polymer having a portion capable of reacting with the compound having an active hydrogen group in an aqueous medium.

The active hydrogen group is not particularly restricted and may be appropriately selected according to purpose. Examples thereof include a hydroxyl group (alcoholic hydroxyl group and phenolic hydroxyl group), an amino group, a carboxyl group and a mercapto group. These may be used alone or in combination of two or more.

The compound having an active hydrogen group is not particularly restricted and may be appropriately selected according to purpose. Nonetheless, amines are preferable since it may polymerize with the polyester resin by an elongation reaction or a crosslinking reaction, provided that the polymer having a portion capable of reacting with the compound having an active hydrogen group is the polyester resin having an isocyanate group.

The amines are not particularly restricted and may be appropriately selected according to purpose. Examples thereof include a diamine, an amine having 3 or more valences, an amino alcohol, an amino mercaptan, an amino acid, and a compound with these amino groups blocked. These may be used alone or in combination of two or more.

Among these, the diamine, and a mixture of the diamine with a small amount of an amine having 3 or more valences are preferable.

The diamine is not particularly restricted and may be appropriately selected according to purpose. Examples thereof include an aromatic diamine, an alicyclic diamine, and an aliphatic diamine. The aromatic diamine is not particularly restricted and may be appropriately selected according to purpose. Examples thereof include phenylene diamine, diethyltoluene diamine, and 4,4'-diaminodiphenylmethane. The alicyclic diamine is not particularly restricted and may be appropriately selected according to purpose. Examples thereof include 4,4'-diamino-3,3'-dimethyldicyclohexylmethane, diaminocyclohexane, and isophorone diamine. The aliphatic diamine is not particularly restricted and may be appropriately selected according to purpose. Examples thereof include ethylene diamine, tetramethylene diamine, and hexamethylene diamine.

The amine having 3 or more valences is not particularly restricted and may be appropriately selected according to purpose. Examples thereof include diethylene triamine and triethylene tetramine.

The amino alcohol is not particularly restricted and may be appropriately selected according to purpose. Examples thereof include ethanolamine, and hydroxyethylaniline.

The amino mercaptan is not particularly restricted and may be appropriately selected according to purpose. Examples thereof include aminoethyl mercaptan, and aminopropyl mercaptan.

The amino acid is not particularly restricted and may be appropriately selected according to purpose. Examples thereof include aminopropionic acid, and aminocaproic acid.

The compound with these amino groups blocked is not particularly restricted and may be appropriately selected according to purpose. Examples thereof include a ketimine compound and an oxazoline compound that the amino groups are blocked with ketones such as acetone, methyl ethyl ketone, and methyl isobutyl ketone.

—Charge Controlling Agent—

The charge controlling agent is not particularly restricted and may be appropriately selected according to purpose. Examples thereof include nigrosine dyes, triphenylmethane dyes, chromium-containing metal complex dyes, molybdic acid chelate pigments, rhodamine dyes, alkoxy amines, quaternary ammonium salts (including fluorine-modified quaternary ammonium salts), alkyl amides, elemental phosphorus or phosphorus compound, elemental tungsten or tungsten compounds, fluorine surfactants, salicylic acid metal salts, and metal salts of salicylic acid derivatives. Specific examples thereof include: BONTRON 03 as nigrosine dyes, BONTRON P-51 as quaternary ammonium salt, BONTRON S-34 as metal-containing azo dye, E-82 as oxynaphthoic acid metal complex, E-84 as salicylic acid metal complex, E-89 as phenol condensate (manufactured by Orient Chemical Industries Co., Ltd.), TP-302, TP-415 as quaternary ammonium salt molybdenum complexes (manufactured by Hodogaya Chemical Co., Ltd.), LRA-901, LR-147 as boron complex (manufactured by Carlit Japan Co., Ltd.), and copper phthalocyanine, perylene, quinacridone, azo pigments, and other polymeric compounds having a functional group such as sulfonic acid group, carboxyl group and quaternary ammonium salt.

A content of the charge controlling agent is not particularly restricted and may be appropriately selected according to purpose. Nonetheless, it is preferably 0.1% by mass to 10% by mass, and more preferably 0.2% by mass to 5% by mass in the toner. When the content exceeds 10% by mass, chargeability of the toner is too large, reducing an effect of a main charge controlling agent and increasing an electrostatic attractive force with a developing roller, which may invite decrease in fluidity or image density of the developer. These charge controlling agents may be melt-kneaded with the masterbatch and a resin, followed by dissolution or dispersion, or of course, it may be added directly in the organic solvent during dissolution or dispersion. Also, it may be fixed on a surface of the toner after toner particles are produced.

—External Additive—

As the external additive, other than oxide fine particles, inorganic fine particles or hydrophobized inorganic fine particles may be used in combination. An average particle diameter of primary particles of hydrophobized inorganic fine particles is not particularly restricted and may be appropriately selected according to purpose. Nonetheless, it is preferably 1 nm to 100 nm, and more preferably 5 nm to 70 nm.

Also, it is preferable to include at least one type of inorganic fine particles with hydrophobized primary particles having an average particle diameter of 20 nm or less and at least one type of inorganic fine particles with primary particles having an average particle diameter of 30 nm or greater.

Also, a specific surface area by a BET method is not particularly restricted and may be appropriately selected according to purpose. Nonetheless, it is preferably 20 $m^2/g$ to 500 $m^2/g$.

The external additive is not particularly restricted and may be appropriately selected according to purpose. Examples thereof include silica fine particles, hydrophobized silica, fatty acid metal salt (e.g. zinc stearate, aluminum stearate, etc.), metal oxide (e.g. titania, alumina, tin oxide, antimony oxide, etc.), and fluoropolymer.

Examples of favorable additives include hydrophobized silica, titania, titanium oxide, and alumina fine particles.

Examples of the silica fine particles include R972, R974, RX200, RY200, R202, R805, R812 (manufactured by Nippon Aerosil Co., Ltd.).

Also, examples of the titania fine particles include P-25 (manufactured by Nippon Aerosil Co., Ltd.), STT-30, STT-65C-S (manufactured by Titan Kogyo, Ltd.), TAF-140 (Fuji Titanium Industry Co., Ltd.), MT-150W, MT-500B, MT-600B, MT-150A (manufactured by Tayca Corporation).

Examples of the hydrophobized titanium oxide fine particles include T-805 (manufactured by Nippon Aerosil Co., Ltd.), STT-30A, STT-65S-S (manufactured by Titan Kogyo, Ltd.), TAF-500T, TAF-1500T (manufactured by Fuji Titanium Industry Co., Ltd.), MT-100S, MT-100T (manufactured by Tayca Corporation), and IT-S (manufactured by Ishihara Sangyo Kaisha Ltd.).

In order to obtain hydrophobized oxide fine particles, hydrophobized silica fine particles, hydrophobized titania fine particles and hydrophobized alumina fine particles, hydrophilic fine particles is treated with a silane coupling agent such as methyltrimethoxysilane, methyltriethoxysilane and octyltrimethoxysilane. Also, oxide fine particles and inorganic fine particles processed with silicone oil, where inorganic fine particles are processed with silicone oil with heat according to necessity, are also favorable.

The silicone oil is not particularly restricted and may be appropriately selected according to purpose. Examples thereof include dimethyl silicone oil, methylphenyl silicone oil, chlorophenyl silicone oil, methylhydrogen silicone oil, alkyl-modified silicone oil, fluorine-modified silicone oil, polyether-modified silicone oil, alcohols modified silicone oil, amino-modified silicone oil, epoxy-modified silicone oil, epoxy-polyether-modified silicone oil, phenol-modified silicone oil, carboxyl-modified silicone oil, mercapto-modified silicone oil, acryl- or methacryl-modified silicone oil, and α-methylstyrene-modified silicone oil.

Examples of the inorganic fine particles include silica, alumina, titanium oxide, barium titanate, magnesium titanate, calcium titanate, strontium titanate, iron oxide, copper oxide, zinc oxide, tin oxide, silica sand, clay, mica, wollastonite, diatomaceous earth, chromium oxide, cerium oxide, colcothar, antimony trioxide, magnesium oxide, zirconium oxide, barium sulfate, barium carbonate, calcium carbonate, silicon carbide, silicon nitride. Among these, silica and titanium dioxide are particularly preferable.

A content of the external additive is not particularly restricted and may be appropriately selected according to purpose. None the less, it is preferably 0.1% by mass to 5% by mass, and more preferably 0.3% by mass to 3% by mass with respect to the toner base particles (toner to which an external additive or moreover a charge controlling agent is not added, and hereinafter referred to in the same manner).

—Fluidity Improving Agent—

The fluidity improving agent is not particularly restricted and may be appropriately selected according to purpose as long as it has increased hydrophobicity by a surface treatment and may prevent degradation of fluidity properties and charge properties even under a high-humidity condition. Examples thereof include a silane coupling agent, a silylating agent, a silane coupling agent having a fluorinated alkyl group, an organic titanate coupling agent, an aluminum-based coupling agent, silicone oil, and modified silicone oil. It is particularly preferable to subject the silica and the titanium oxide to a surface treatment with such a fluidity improving agent and to use them as hydrophobized silica and hydrophobized titanium oxide.

—Cleanability Improving Agent—

The cleanability improving agent is not particularly restricted and may be appropriately selected according to purpose as long as it is added to the toner in order to remove a developer after transfer remaining on a photoconductor or a primary transfer medium (a so-called intermediate transfer belt, etc.). Examples thereof include metal salts of a fatty acid such as stearic acid, e.g. zinc stearate, calcium stearate, and polymer fine particles, which is produced by soap-free emulsion polymerization, e.g. polymethyl methacrylate fine particles, polystyrene fine particles. The polymer fine particles are not particularly restricted and may be appropriately selected according to purpose. Those preferable have a relatively particle size distribution, and those having a volume-average particle diameter of 0.01 μm to 1 μm are favorable.

—Magnetic Material—

The magnetic material is not particularly restricted and may be appropriately selected according to purpose. Examples thereof include iron powder, magnetite and ferrite. Among these, white ones are preferable in view of color tone.

<Acid Value>

An acid value of the toner is not particularly restricted and may be appropriately selected according to purpose. Nonetheless, in view of controlling low-temperature fixing property (lower-limit fixing temperature), hot offset occurrence temperature, etc., it is preferably 0.5 mgKOH/g to 40 mgKOH/g. When the acid value is less than 0.5 mgKOH/g, production stability may degrade since an effect of improving dispersion stability by a base during production may not be obtained, and an elongation reaction and/or a crosslinking reaction are likely to proceed in using the prepolymer. When the acid value exceeds 40 mgKOH/g, the elongation reaction and/or the crosslinking reaction is insufficient in using the prepolymer, and high temperature-resistant offset property may degrade.

<Glass Transition Temperature (Tg)>

The toner of the present invention has a difference between a glass transition temperature in a first heating Tg1st and a glass transition temperature in a second heating Tg2nd (Tg1st−Tg2nd) of 10° C. or greater.

When the difference between Tg1st and Tg2nd (Tg1st−Tg2nd) is less than 10° C., a softening effect of the crystalline polyester to the non-crystalline polyester is low, and low-temperature fixing property may not be sufficiently exhibited.

Further, the difference between the glass transition temperature in a first heating Tg1st and the glass transition temperature in a second heating Tg2nd (Tg1st−Tg2nd) is preferably less than 30° C. When the difference between Tg1st and Tg2nd (Tg1st−Tg2nd) is 30° C. or greater, re-crystallization of the crystalline polyester after fixing may become difficult, and blocking property of a printed matter may degrade.

Also, the glass transition temperature (Tg) of the toner is not particularly restricted and may be appropriately selected according to purpose. Nonetheless, the glass transition temperature calculated in the first heating (Tg1st) of differential scanning calorimetry (DSC) is preferably 20° C. or greater and less than 60° C., and more preferably 30° C. or greater and 50° C. or less. Thereby, low-temperature fixing property, heat-resistant storage stability and high durability may be obtained. When the Tg1st is less than 20° C., blocking in a developing apparatus or filming to a photoconductor may occur. When it is 60° C. or greater, low-temperature fixing property may decrease.

Also, in the differential scanning calorimetry (DSC) of the toner, the glass transition temperature calculated in the second heating (Tg2nd) is preferably 10° C. or greater and less than 30° C. When the Tg2nd is less than 10° C., image blocking property of a printed matter may degrade, and blocking in a developing apparatus and filming to a photoconductor may occur. When it is 30° C. or greater, low-temperature fixing property may decrease.

Here, details of the glass transition temperature calculated in the first heating (Tg1st) and the glass transition temperature calculated in the second heating (Tg2nd) in the differential scanning calorimetry are described later.

<Volume-Average Particle Diameter>

A volume-average particle diameter of the toner is not particularly restricted and may be appropriately selected according to purpose. Nonetheless, it is preferably 3 μm or greater and 7 μm or less. Also, a ratio of the volume-average particle diameter to a number-average particle diameter is preferably 1.2 or less. Also, it is preferable to include a component having a particle diameter of 2 μm or less by 1% by number or greater and 10% by number or less.

<<Measuring Method by Gel Permeation Chromatography>>

A weight-average molecular weight (Mw) and a number-average molecular weight (Mn) of the modified crystalline polyester resin and the non-crystalline polyester resin, respectively, may be measured by gel permeation chromatography as follows.

<Measurement Conditions>

Gel permeation chromatography (GPC) measuring apparatus: GPC-8220GPC (manufactured by Tosoh Corporation)

Column: TSK-GEL SUPER HZM-H 15 cm in triplicate (manufactured by Tosoh Corporation)

Temperature: 40° C.

Solvent: ortho-dichlorobenzene

Flow rate: 0.35 mL/min

Sample: 0.4 mL of a 0.15-% sample is injected

Pre-treatment of sample: the target sample is dissolved in ortho-dichlorobenzene by 0.15% by mass, followed by filtration with a 0.2-μm filter. The filtrate is used as a sample. A measurement is taken by injecting 100 μL of the sample solution.

In measuring a molecular weight of a sample, a molecular weight distribution of the sample is calculated from a relation between logarithmic values of a calibration curve created from several types of monodisperse polystyrene standard samples and a number of counts. As the standard polystyrene sample for creating the calibration curve, SHOWDEX STANDARD Std. Nos. S-7300, S-210, S-390, S-875, S-1980, S-10.9, S-629, S-3.0 and S-0.580 manufactured by Showa Denko KK may be used. As a detector, an R1 (refractive index) detector may be used.

<<Method for Measuring Viscoelasticity>>

The dynamic viscoelastic properties (storage elastic modulus G', loss elastic modulus G") of the resin and the toner may be measured using a dynamic viscoelasticity measuring apparatus (e.g. ARES (manufactured by TA Instruments, Inc.)). The measurement is conducted under a condition of a frequency of 1 Hz. A sample is formed in pellets having a diameter of 8 mm and a thickness of 1 mm to 2 mm, fixed on a parallel plate having a diameter of 8 mm, which is then stabilized at 40° C., and heated to 200° C. at a heating rate of 2.0° C./min with a frequency of 1 Hz (6.28 rad/s) and a strain amount of 0.1% (strain amount control mode), and a measurement is taken.

<<Method for Measuring Acid Value and Hydroxyl Value>>

The hydroxyl value may be measured by a method which conforms to JIS K0070-1966.

Specifically, first, 0.5 g of a sample is accurately weighed in a 100-mL volumetric flask, to which 5 mL of an acetylation reagent is added. Next, the flask is heated in a warm bath of 100° C.±5° C. for 1 hour to 2 hours, and the flask is taken out from the warm bath and allowed to cool. Further, water is added to the flask, and the flask is shaken to decompose acetic anhydride. Next, in order to decompose acetic anhydride completely, the flask is heated again in a warm bath for 10 minutes or greater, and a wall of the flask is thoroughly washed with an organic solvent.

Further, a hydroxyl value is measured at 23° C. using a potential difference automatic titration apparatus DL-53 TITRATOR (manufactured by Mettler-Toledo International Inc.) and an electrode DG113-SC (manufactured by Mettler-Toledo International Inc.) and analyzed using an analysis software LABX LIGHT VERSION 1.00.000. Here, a mixed solvent of 120 mL of toluene and 30 mL of ethanol is used for calibration of the apparatus.

At this time, measurement conditions are as follows.

| [Measurement conditions] | |
|---|---|
| Stir | |
| Speed[%] | 25 |
| Time[s] | 15 |
| EQP titration | |
| Titrant/Sensor | |
| Titrant CH3ONa | |
| Concentration[mol/L] | 0.1 |
| Sensor DG115 | |
| Unit of measurement | mV |
| Predispensing to volume | |
| Volume[mL] | 1.0 |
| Wait time[s] | 0 |
| Titrant addition Dynamic | |
| dE(set) [mV] | 8.0 |
| dV(min) [mL] | 0.03 |
| dV(max) [mL] | 0.5 |
| Measure mode Equilibrium controlled | |
| dE[mV] | 0.5 |
| dt[s] | 1.0 |
| t(min) [s] | 2.0 |
| t(max) [s] | 20.0 |
| Recognition | |
| Threshold | 100.0 |
| Steepest jump only | No |
| Range | No |
| Tendency | None |
| Termination | |
| at maximum volume[mL] | 10.0 |
| at potential | No |
| at slope | No |
| after number EQPs | Yes |
| n = 1 | |
| comb. termination conditions | No |
| Evaluation | |
| Procedure | Standard |
| Potential1 | No |
| Potential2 | No |
| Stop for reevaluation | No |

The acid value may be measured by a method which conforms to JIS K0070-1992.

Specifically, first, 0.5 g of a sample (0.3 g in ethyl acetate soluble portion) is added to 120 mL of toluene and stirred at 23° C. for about 10 hours for dissolution. Next, 30 mL of ethanol is added, and a sample solution is obtained. Here, if the sample does not dissolve, a solvent such as dioxane and tetrahydrofuran is used. Further, an acid value is measured at 23° C. using a potential difference automatic titration apparatus DL-53 TITRATOR (manufactured by Mettler-Toledo International Inc.) and an electrode DG113-SC (manufactured by Mettler-Toledo International Inc.) and analyzed using an analysis software LABX LIGHT VERSION 1.00.000. Here, a mixed solvent of 120 mL of toluene and 30 mL of ethanol is used for calibration of the apparatus.

At this time, measurement conditions are the same as those for the hydroxyl value.

The acid value may be measured as above. Specifically, the sample is titrated with 0.1-N potassium hydroxide/alcohol solution, which is standardized beforehand, and from the titer, the acid value is calculated by: acid value [mgKOH/g] =titer [mL]×N×56.1 [g/mL]/mass of sample [g](where N is a factor of 0.1-N potassium hydroxide/alcohol solution).

<<Method for Measuring Melting Point and Glass Transition Temperature (Tg)>>

A melting point and glass transition temperature (Tg) of the toner and various materials in the present invention may be measured using, for example, a DSC system (differential scanning calorimeter) ("DSC-60", manufactured by Shimadzu Corporation).

Specifically, an exothermic peak temperature, a melting point and a glass transition temperature of a target sample may be measured according to the following procedure.

First, about 5.0 mg of a target sample is placed in a sample container made of aluminum, and the sample container is placed on a holder unit and set in an electric furnace. Next, it is heated under a nitrogen atmosphere from 0° C. to 150° C. at a heating rate of 10° C./min. Thereafter, it is cooled from 150° C. to 0° C. at a cooling rate of 10° C./min and further heated to 150° C. at a heating rate of 10° C./min. DSC curves are measured using the differential scanning calorimeter ("DSC-60", manufactured by Shimadzu Corporation).

From the obtained DSC curves, using an analysis program "Endothermic Shoulder Temperature" in the DSC-60 system, the DSC curve in the first heating is selected, and a glass transition temperature in the first heating of the target sample may be obtained. Also, using "Endothermic Shoulder Temperature", the DSC curve in the second heating is selected, and a glass transition temperature in the second heating of the target sample may be obtained.

Also, from the obtained DSC curves, using an analysis program "Endothermic Peak Temperature" in the DSC-60 system, the DSC curve in the first heating is selected, and a melting point in the first heating of the target sample may be obtained. Also, using "Endothermic Peak Temperature", the DSC curve in the second heating is selected, and a melting point in the second heating of the target sample may be obtained.

In the present invention, a glass transition temperature in the first heating and a glass transition in the second heating of a toner used as the target sample are defined as Tg1st and Tg2nd, respectively.

Also, in the present invention, a melting point and Tg in the second heating of a structural component are defined as a melting point and Tg of the structural component.

<<Method for Measuring Particle Size Distribution>>

A volume-average particle diameter (D4), a number-average particle diameter (Dn), and a ratio thereof (D4/Dn) of the toner may be measured, for example, using COULTER COUNTER TA-II or COULTER MULTISIZER II (both manufactured by Coulter). In the present invention, COULTER MIULTISIZER II is used as a measuring apparatus. Hereinafter, a measurement method is described.

First, 0.1 mL to 5 mL of a surfactant (preferably, polyoxyethylene alkyl ether (nonionic surfactant)) is added as a dispersant to 100 mL to 150 mL of an aqueous electrolyte. Here, the aqueous electrolyte is prepared as a 1-% by mass NaCl aqueous solution using a primary sodium chloride, and ISOTON-II (manufactured by Coulter) may be used, for example. Here, 2 mg to 20 mg of a measurement sample is further added. The aqueous electrolyte in which the sample is suspended is subjected to a dispersion treatment in an ultrasonic disperser for about 1 minute to 3 minutes. By the measuring apparatus, using a 100-μm aperture as an aperture, a volume and a number of the toner particles or the toner are measured, and a volume distribution and a number distribution are calculated. From the obtained distributions, a volume-average particle diameter (D4) and a number-average particle diameter (Dn) of the toner may be obtained.

As channels, the following 13 channels are used: 2.00 μm or greater and less than 2.52 μm; 2.52 μm or greater and less than 3.17 μm; 3.17 μm or greater and less than 4.00 μm; 4.00 μm or greater and less than 5.04 μm; 5.04 μm or greater and less than 6.35 μm; 6.35 μm or greater and less than 8.00 μm; 8.00 μm or greater and less than 10.08 μm; 10.08 μm or greater and less than 12.70 μm; 12.70 μm or greater and less than 16.00 μm; 16.00 μm or greater and less than 20.20 μm; 20.20 μm or greater and less than 25.40 μm; 25.40 μm or greater and less than 32.00 μm; and 32.00 μm or greater and less than 40.30 μm, and particles having a particle diameter of 2.00 μm or greater and less than 40.30 μm are targeted.

A method for manufacturing the toner is not particularly restricted and may be appropriately selected according to purpose. As a specific example thereof, it is preferable to granulate by dispersing, in an aqueous medium, an oil phase including at least the non-crystalline polyester resin, the modified crystalline polyester resin, the releasing agent, and the colorant (which may also be referred to as toner materials, hereinafter) in an organic solvent. Further, the granulation in the aqueous medium is more preferably carried out by: preparing a dispersion by dispersing in an aqueous medium an oil phase that at least a compound having an active hydrogen group, the polymer having a portion capable of reacting with the compound having an active hydrogen group, the non-crystalline polyester resin, the modified crystalline polyester resin, the releasing agent, and the colorant are dissolved or dispersed in an organic solvent; subjecting the compound having an active hydrogen group and the polymer having a portion capable of reacting with the compound having an active hydrogen group to a crosslinking or elongation reaction in the aqueous medium; and removing the organic solvent from an obtained dispersion.

One example of the method for manufacturing a toner includes a heretofore known dissolution suspension method.

Also, as another example of the method for manufacturing a toner, a method for producing toner base particles while producing a product of an elongation reaction and/or a crosslinking reaction of the compound having an active hydrogen group and the polymer having a portion capable of reacting with the compound having an active hydrogen group (hereinafter referred to as "adhesive base materials") is described hereinafter. In such a method, preparation of an aqueous medium, preparation of an oil phase including toner materials, emulsification or dispersion of the toner material, removal of an organic solvent, etc. are carried out.

—Preparation of Aqueous Medium (Aqueous Phase)—

The aqueous medium may be prepared, for example, by dispersing conventionally well-known resin particles in an aqueous medium. An amount of the resin particles added to the aqueous medium is not particularly restricted and may be appropriately selected according to purpose. Nonetheless, it is preferably 0.5% by mass to 10% by mass.

The aqueous medium is not particularly restricted and may be appropriately selected according to purpose. Examples thereof include water, a solvent miscible with water, and a mixture thereof. These may be used alone or in combination of two or more.

Among these, water is preferable.

The solvent miscible with water is not particularly restricted and may be appropriately selected according to purpose. Examples thereof include alcohols, dimethylformamide, tetrahydrofuran, cellosolves, and lower ketones. The alcohols are not particularly restricted and may be appropriately selected according to purpose. Examples thereof include methanol, isopropanol, and ethylene glycol. The lower ketones are not particularly restricted and may be appropriately selected according to purpose. Examples thereof include acetone, and methyl ethyl ketone.

—Preparation of Oil Phase—

The oil phase including toner materials is prepared by dissolving or dispersing toner materials including the compound having an active hydrogen group, the polymer having a portion capable of reacting with the compound having an active hydrogen group, the crystalline polyester resin, the non-crystalline polyester resin, the releasing agent, and the colorant, etc. in an organic solvent.

The organic solvent is not particularly restricted and may be appropriately selected according to purpose, and those having a boiling point of less than 150° C. are preferable in view of easy removal.

The organic solvents having a boiling point of less than 150° C. are not particularly restricted and may be appropriately selected according to purpose. Examples thereof include toluene, xylene, benzene, carbon tetrachloride, methylene chloride, 1,2-dichloroethane, 1,1,2-trichloroethane, trichlorethylene, chloroform, monochlorobenzene, dichloroethylidene, methyl acetate, ethyl acetate, methyl ethyl ketone, and methyl isobutyl ketone. These may be used alone or in combination of two or more.

Among these, ethyl acetate, toluene, xylene, benzene, methylene chloride, 1,2-dichloroethane, chloroform, and carbon tetrachloride are preferable, and ethyl acetate is more preferable.

—Emulsification or Dispersion—

Emulsification or dispersion of the toner materials may be carried out by dispersing the oil phase including the toner materials in the aqueous medium (step 1: preparation of dispersion).

Then, in emulsifying or dispersing the toner materials, an adhesive base material is produced by subjecting the compound having an active hydrogen group and the polymer having a portion capable of reacting with the compound having an active hydrogen group to an elongation reaction and/or a crosslinking reaction (step 2: crosslinking or elongation reaction).

The adhesive base material is preferably produced, for example, by emulsifying or dispersing the oil phase including a polymer reactive with an active hydrogen group such as polyester prepolymer having an isocyanate group in the aqueous medium along with a compound having an active hydrogen group such as amines so as to subject them to an elongation reaction and/or a crosslinking reaction in the aqueous medium. Alternatively, it may also be produced by emulsifying or dispersing the oil phase including the toner materials in an aqueous medium to which a compound having an active hydrogen group is added beforehand so as to subject them to an elongation reaction and/or a crosslinking reaction in the aqueous medium or by emulsifying or dispersing the oil phase including the toner materials in an aqueous medium, followed by adding a compound having an active hydrogen group so as to subject them to an elongation reaction and/or a crosslinking reaction from particle interfaces in the aqueuos medium.

Here, in the case of the elongation reaction and/or the crosslinking reaction from particle interfaces, a urea-modified polyester resin is formed preferentially on a surface of the toner to be generated, and a concentration gradient of the urea-modified polyester resin may be provided in the toner.

Reaction conditions for producing the adhesive base material (reaction time, reaction temperature) are not particularly restricted, and they may be appropriately selected according to a combination of the compound having an active hydrogen group and the polymer having a portion capable of reacting with the compound having an active hydrogen group.

The reaction time is not particularly restricted and may be appropriately selected according to purpose. Nonetheless, it is preferably 10 minutes to 40 hours, and more preferably 2 hours to 24 hours.

The reaction temperature is not particularly restricted and may be appropriately selected according to purpose. Nonetheless, it is preferably 0° C. to 150° C., and more preferably 40° C. to 98° C.

A method for forming stably a dispersion including a polymer having a portion capable of reacting with the compound having an active hydrogen group such as polyester prepolymer having an isocyanate group in the aqueous medium is not particularly restricted and may be appropriately selected according to purpose. Examples thereof include a method of adding an oil phase prepared by dissolving or dispersing the toner materials in the organic solvent and dispersing the oil phase in the aqueous medium by a shearing force.

A dispersing machine for the dispersion is not particularly restricted and may be appropriately selected according to purpose. Examples thereof include a low-speed shearing disperser, a high-speed shearing disperser, a frictional disperser, a high-pressure jet disperser, and an ultrasonic disperser.

Among these, the high-speed shearing disperser is preferable in view of controlling the particles diameter of the dispersion (oil droplets) within 2 μm to 20 μm.

When the high-speed shearing disperser is used, conditions such as number of revolution, dispersion time and dispersion temperature may be appropriately selected according to purpose.

The number of revolutions is not particularly restricted and may be appropriately selected according to purpose. Nonetheless, it is preferably 1,000 rpm to 30,000 rpm, and more preferably 5,000 rpm to 20,000 rpm.

The dispersion time is not particularly restricted and may be appropriately selected according to purpose. In the case of a batch method, it is preferably 0.1 minutes to 5 minutes.

The dispersion temperature is not particularly restricted and may be appropriately selected according to purpose. Under pressurization, it is preferably 0° C. to 150° C., and more preferably 40° C. to 98° C. Here, in general, dispersion is easier when the dispersion temperature is higher.

An amount of the aqueous medium used for emulsifying or dispersing the toner materials is not particularly restricted and may be appropriately selected according to purpose. Nonetheless, it is preferably 50 parts by mass to 2,000 parts by mass, and more preferably 100 parts by mass to 1,000 parts by mass with respect to 100 parts by mass of the toner material.

When the used amount of the aqueous medium is less than 50 parts by mass, toner base particles having a predetermined particle diameter may not be obtained due to poor dispersion condition of the toner material. The amount exceeding 2,000 parts by mass may increase production costs.

In emulsifying or dispersing the oil phase including the toner materials, it is preferable to use a dispersant in view of stabilizing dispersion of oil droplets, etc. and forming them in a desired shape as well as sharpening its particle size distribution.

The dispersant is not particularly restricted and may be appropriately selected according to purpose. Examples thereof include a surfactant, a hardly water-soluble inorganic compound dispersant, and a polymeric protective colloid. These may be used alone or in combination of two or more.

Among these, the surfactant is preferable.

The surfactant is not particularly restricted and may be appropriately selected according to purpose. For example, an anionic surfactant, a cationic surfactant, a non-ionic surfactant, and an amphoteric surfactant may be used.

The anionic surfactant is not particularly restricted and may be appropriately selected according to purpose. Examples thereof include alkylbenzene sulfonate, α-olefin sulfonate, and a phosphate ester.

Among these, a surfactant having a fluoroalkyl group is preferable.

A catalyst may be used in the elongation reaction and/or the crosslinking reaction to produce the adhesive base material.

The catalyst is not particularly restricted and may be appropriately selected according to purpose. Examples thereof include dibutyltin laurate and dioctyltin laurate.

—Removing Organic Solvent (Step 3)—

A method for removing the organic solvent from the dispersion such as emulsified slurry is not particularly restricted and may be appropriately selected according to purpose. Examples thereof include; a method to evaporate the organic solvent in the oil droplets by heating gradually the overall reaction system; and a method to remove the organic solvent in the oil droplets by spraying the dispersion in a dry atmosphere.

Upon removing the organic solvent, the toner base particles are formed. The toner base particles may be subjected to cleaning, drying, etc. and further to classification, etc. The classification may be carried out by removing fine particles portion with a cyclone, a decanter, or a centrifuge, and the classification operation may be carried out after drying.

The obtained toner base particles may be mixed with particles such as external additive and charge controlling agent. At this time, application of a mechanical impact may suppress departure of the particles, e.g. the external additive, from a surface of the toner base particles.

A method for applying the mechanical impact is not particularly restricted and may be appropriately selected according to purpose. Examples thereof include: a method to apply an impact force to a mixture using blades rotating at high speed; and a method to put the mixture in a high-speed airflow, which is accelerated to have the particles collide with one another or against a suitable collision plate.

An apparatus used for the method is not particularly restricted and may be appropriately selected according to purpose. Examples thereof include ANGMILL (manufactured by Hosokawa Micron Co., Ltd.), a remodeled apparatus of 1-TYPE MILL (manufactured by Nippon Pneumatic Mfg. Co., Ltd.) with a reduced grinding air pressure, HYBRIDIZATION SYSTEM (manufactured by Nara Kikai Seisakusho Co., Ltd.), KRYPTRON SYSTEM (manufactured by Kawasaki Heavy Industries, Ltd.) and an automatic mortar.

(Developer)

A developer of the present invention includes at least the toner, and it further includes other components such as carrier appropriately selected according to necessity carrier.

Thereby, a high-quality image with superior transferability and chargeability may be stably formed. Here, the developer may be a one-component developer or a two-component developer, but it is preferably the two-component developer in view of improved lifetime when it is used for a high-speed printer corresponding to recent improvement in information processing speed.

When the developer is used as the one-component developer, there is little variation in the particle size of the toner even when the toner is balanced. Also, there is little filming of the toner to a developing roller or fusion of the toner to a member such as blade for thinning the toner. Moreover, favorable and stable developing property and images may be obtained after a long-term stirring of a developing apparatus.

When the developer is used as the two-component developer, there is little variation in the particle size of the toner even when the toner is balanced, and favorable and stable developing property may be obtained after a long-term stirring of a developing apparatus.

The toner may be mixed with the carrier for usage when it is used for the two-component developer. A content of the carrier in the two-component developer is not particularly restricted and may be appropriately selected according to purpose. Nonetheless, it is preferably 90% by mass to 98% by mass, and more preferably 93% by mass to 97% by mass.

<Carrier>

The carrier is not particularly restricted and may be appropriately selected according to purpose. Nonetheless, one including a core material and a resin layer which coats the core material is preferable.

—Core Material—

A material of the core material is not particularly restricted and may be appropriately selected according to purpose. Examples thereof include a manganese-strontium (Mg—Sr) material and a manganese-magnesium (Mn—Mg) material of 50 emu/g to 90 emu/g. In view of ensuring an image density, a high-magnetization material such as iron powder of 100 emu/g or greater and magnetite of 75 emu/g to 120 emu/g is preferably used. Also, a low-magnetization material such as copper-zinc (Cu—Zn) material (30 emu/g to 80 emu/g) is preferable since it is advantageous in terms of image quality by weakening the toner in a state of ear standing on a photoconductor.

These may be used alone or in combination of two or more.

A volume-average particle diameter of the core material is not particularly restricted and may be appropriately selected according to purpose. Nonetheless, it is preferably 10 μm to 150 μm, and more preferably 40 μm to 100 μm. When the volume-average particle diameter is less than 10 μm, fine powder increases in the carrier, and magnetization per one particle may decrease. This may result in carrier scattering. When it exceeds 150 μm, specific surface area decreases, which may result in toner scattering. In a full-color printing having many solid portions, reproduction of the solid portions may degrade in particular.

—Resin Layer—

A material of the resin layer is not particularly restricted and may be appropriately selected from heretofore known resins according to purpose. Examples thereof include an amino resin, a polyvinyl resin, a polystyrene resin, a polyhalogenated olefin, a polyester resin, polycarbonate resin, polyethylene, polyvinyl fluoride, polyvinylidene fluoride, polytrifluoroethylene, polyhexafluoropropylene, a copolymer of vinylidene fluoride and an acrylic monomer, a copolymer of vinylidene fluoride and vinyl fluoride, a fluoro-terpolymer (fluorinated triple (multiple) copolymer) such as terpolymer of tetrafluoroethylene, vinylidene fluoride and non-fluorinated monomer, and a silicone resin. These may be used alone or in combination of two or more.

The amino resin is not particularly restricted and may be appropriately selected according to purpose. Examples thereof include a urea-formaldehyde resin, a melamine resin, a benzoguanamine resin, a urea resin, a polyamide resin, and an epoxy resin.

The polyvinyl resin is not particularly restricted and may be appropriately selected according to purpose. Examples thereof include an acrylic resin, polymethyl methacrylate, polyacrylonitrile, polyvinyl acetate, polyvinyl alcohol, and polyvinyl butyral.

The polystyrene resin is not particularly restricted and may be appropriately selected according to purpose. Examples thereof include polystyrene, and a styrene-acrylic copolymer.

The polyhalogenated olefin is not particularly restricted and may be appropriately selected according to purpose. Examples thereof include polyvinyl chloride.

The polyester resin is not particularly restricted and may be appropriately selected according to purpose. Examples thereof include polyethylene terephthalate, and polybutylene terephthalate.

The resin layer may include electrically conductive powder, etc., according to necessity. The electrically conductive powder is not particularly restricted and may be appropriately selected according to purpose. Examples thereof include metal powder, carbon black, titanium oxide, tin oxide, and zinc oxide. An average particle diameter of the electrically conductive powder is not particularly restricted and may be appropriately selected according to purpose. Nonetheless, it is preferably 1 μm or less. When the average particles diameter exceeds 1 μm, it may be difficult to control electrical resistance.

The resin layer may be formed by: preparing a coating solution by dissolving a silicone resin, etc. in a solvent; and coating and drying the coating solution on a surface of the core material using a heretofore known coating method, followed by baking.

The coating method is not particularly restricted and may be appropriately selected according to purpose. Examples thereof include a dip coating method, a spraying method, and a brushing method.

The solvent is not particularly restricted and may be appropriately selected according to purpose. Examples thereof include toluene, xylene, methyl ethyl ketone, methyl isobutyl ketone, and butyl cellosolve acetate.

The baking may be an external heating method or an internal heating method. Examples thereof include: a method using a stationary electric furnace, a fluidized electric furnace, a rotary electric furnace, a burner furnace, etc.; and a method using a microwave.

A content of the resin layer in the carrier is not particularly restricted and may be appropriately selected according to purpose. Nonetheless, it is preferably 0.01% by mass to 5.0% by mass. When the content is less than 0.01% by mass, the resin layer may not be formed uniformly on a surface of the core material. When it exceeds 5.0% by mass, the resin layer is thick, causing fusion within the carrier, and as a result, uniformity of the carrier may decrease.

(Image Forming Method)

An image forming method of the present invention includes at least:

an electrostatic latent image formation step, which forms an electrostatic latent image on an electrostatic latent image bearing member;

a developing step which forms a visible image by developing the electrostatic latent image with a toner;

a transfer step which transfers the visible image to a recording medium; and a fixing step which fixes a transfer image transferred on the recording medium, and it further includes other steps according to necessity.

The toner is the toner of the present invention.

EXAMPLES

The present invention is explained below in more detail based on examples, but the examples shall not be construed as limiting the scope of the present invention. Here, a term "part" denotes "part by mass".

~Synthesis of Crystalline Polyester Resin~

<Production of Crystalline Polyester Resin 1>

In a reactor equipped with a cooling tube, a stirrer, and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.1, and 400 ppm of titanium dihydroxybis(triethanolaminate) as a polycondense catalyst with respect to a mass of total monomer were placed. It was reacted for 8 hours under a stream of nitrogen at 180° C. while distilling generated water. Next, under a stream of nitrogen, it was reacted for 4 hours while gradually heating to 220° C. and distilling generated water and residual monomers, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2=1$, which was reacted at 80° C. for 2 hours. Next, under a reduced pressure, ethyl acetate was distilled, and [crystalline polyester resin 1] was obtained. Physical property values of the obtained crystalline polyester resin are shown in Table 1. Here, the physical properties of the crystalline polyester resin were measured by the methods described above (hereinafter the same shall apply).

<Production of Crystalline Polyester Resin 2>

In a reactor equipped with a cooling tube, a stirrer and a nitrogen inlet tube, 100% by mole of adipic acid as an acid monomer, 70% by mole of 1,4-butanediol and 30% by mole of 1,5-pentanediol as alcohol monomers, with a charge ratio of the acid monomer and the alcohol monomers OH/COOH=1.1, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomers, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2=1$, which was reacted at 80° C. for 2 hours. Next, under a reduced pressure, ethyl acetate was distilled, and [crystalline polyester resin 2] was obtained. Physical property values of the obtained crystalline polyester resin are shown in Table 1.

<Production of Crystalline Polyester Resin 3>

In a reactor equipped with a cooling tube, a stirrer and a nitrogen inlet tube, 100% by mole of dodecanedioic acid as an acid monomer, 100% by mole of 1,10-decanediol as an alcohol monomer, with a charge ratio of the acid monomer and the alcohol monomer OH/COOH=1.1, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220 and distilling generated water and residual monomer, and the reaction was continued further under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 3] was obtained. Physical property values of the obtained crystalline polyester resin are shown in Table 1.

<Production of Crystalline Polyester Resin 4>

In a reactor equipped with a cooling tube, a stirrer and a nitrogen inlet tube, 100% by mole of adipic acid as an acid monomer, 50% by mole of 1,4-butanediol, 30% by mole of 1,5-pentanediol and 20% by mole of 1,6-hexanediol as alcohol monomers, with a charge ratio of the acid monomer and the alcohol monomers OH/COOH=1.1, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 4] was obtained. Physical property values of the obtained crystalline polyester resin are shown in Table 1.

<Production of Crystalline Polyester Resin 5>

In a reactor equipped with a cooling tube, a stirrer and a nitrogen inlet tube, 100% by mole of dodecanedioic acid as an acid monomer, 100% by mole of 1,12-dodecanediol as an alcohol monomer, with a charge ratio of the acid monomer and the alcohol monomer OH/COOH=1.1, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 5] was obtained. Physical property values of the obtained crystalline polyester resin are shown in Table 1.

<Production of Crystalline Polyester Resin 6>

In a reactor equipped with a cooling tube, a stirrer and a nitrogen inlet tube, 100% by mole of terephthalic acid as an acid monomer, 50% by mole of 1,4-butanediol and 50% by mole of 1,6-hexanediol as an alcohol monomer, with a charge ratio of the acid monomer and the alcohol monomers OH/COOH=1.1, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 6] was obtained. Physical property values of the obtained crystalline polyester resin are shown in Table 1.

<Production of Crystalline Polyester Resin 7>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.05, and 400 ppm of titanium dihydroxybis(triethanolaminate) as a polycondense catalyst with respect to a mass of total monomer were placed. It was reacted under a stream of nitrogen at 180° C. for 12 hours while distilling generated water. Next, under a stream of nitrogen, it was reacted for 6 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 7] was obtained. Physical property values of the obtained crystalline polyester resin are shown in Table 1.

<Production of Crystalline Polyester Resin 8>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.3, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.5, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 8] was obtained. Physical property values of the obtained crystalline polyester resin are shown in Table 1.

<Production of Crystalline Polyester Resin 9>

In a reactor equipped with a cooling tube, a stirrer and a nitrogen inlet tube, 100% by mole of dodecanedioic acid, as an acid monomer, 100% by mole of 1,6-hexanediol as an alcohol monomer, with a charge ratio of the acid monomer and the alcohol monomer OH/COOH=1.03, and 400 ppm of titanium dihydroxybis(triethanolaminate) as a polycondense catalyst with respect to a mass of total monomer were placed. It was reacted under a stream of nitrogen at 180° C. for 12 hours while distilling generated water. Next, under a stream of nitrogen, it was reacted for 8 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.6, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 9] was obtained. Physical property values of the obtained crystalline polyester resin are shown in Table 1.

<Production of Crystalline Polyester Resin 10>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.35, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 3 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.4, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 10] was obtained. Physical property values of the obtained crystalline polyester resin are shown in Table 1.

<Production of Crystalline Polyester Resin 11>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.15, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.75, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 11] was obtained. Physical property values of the obtained crystalline polyester resin are shown in Table 1.

<Production of Crystalline Polyester Resin 12>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.1, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.3, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 12] was obtained. Physical property values of the obtained crystalline polyester resin are shown in Table 1.

<Production of Crystalline Polyester Resin 13>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.15, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.8, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 13] was obtained. Physical property values of the obtained crystalline polyester resin are shown in Table 1.

<Production of Crystalline Polyester Resin 14>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.08, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of 5 mmHg to 20 mmHg until obtained crystalline polyester had an acid value of 1 mgKOH/g or less.

The obtained crystalline polyester was moved in a reactor equipped with a cooling tube, a stirrer and a nitrogen inlet tube, to which isophorone diisocyanate (IPDI) diluted to 50% by mass by ethyl acetate was added with a ratio of a hydroxyl value of the crystalline polyester and the isocyanate group NCO/OH=0.2, and it was reacted under a stream of nitrogen at 80° C. for 5 hours. Thereafter, isophorone diamine was added to the isocyanate-modified crystalline polyester with $NCO/NH_2$=1, which was reacted at 80° C. for 2 hours. Next, under a reduced pressure, ethyl acetate was distilled, and [crystalline polyester resin 14] was obtained. Physical property values of the obtained crystalline polyester resin are shown in Table 1.

<Production of Crystalline Polyester Resin 15>

In a reactor equipped with a cooling tube, a stirrer and a nitrogen inlet tube, 100% by mole of dodecanedioic acid as an acid monomer, 100% by mole of 1,6-hexanediol as an alcohol monomer, with a charge ratio of the acid monomer and the alcohol monomer OH/COOH=1.08, and 400 ppm of titanium dihydroxybis(triethanolaminate) as a polycondense catalyst with respect to a mass of total monomer were placed. It was reacted under a stream of nitrogen at 180° C. for 8 hours while distilling generated water. Next, under a stream of nitrogen, it was reacted for 4 hours while gradually heating to 220° C. and distilling generated water and residual monomer, and the reaction was continued under a reduced pressure of under a reduced pressure of 5 mmHg to 20 mmHg until obtained crystalline polyester had an acid value of 1 mgKOH/g or less, and [crystalline polyester resin 15] was obtained. Physical property values of the obtained crystalline polyester resin are shown in Table 1.

TABLE 1

| | Melting point (° C.) | Mw | ≤1,000 (% by mass) | ≤500 (% by mass) | G' (+20° C.) (Pa · s) | Half width | Crystallinity |
|---|---|---|---|---|---|---|---|
| Crystalline polyester resin 1 | 70 | 30,000 | 1.5 | 0.5 | $2.3 \times 10^3$ | 0.5 | Yes |
| Crystalline polyester resin 2 | 52 | 28,000 | 1.6 | 0.7 | $1.5 \times 10^3$ | 0.8 | Yes |
| Crystalline polyester resin 3 | 78 | 32,000 | 1.3 | 0.4 | $3.8 \times 10^3$ | 0.4 | Yes |
| Crystalline polyester resin 4 | 82 | 35,000 | 1.2 | 0.3 | $5.4 \times 10^3$ | 0.4 | Yes |
| Crystalline polyester resin 5 | 48 | 25,000 | 1.5 | 0.7 | $1.3 \times 10^3$ | 0.9 | Yes |
| Crystalline polyester resin 6 | 78 | 30,000 | 1.4 | 0.5 | $5.5 \times 10^3$ | 0.4 | Yes |
| Crystalline polyester resin 7 | 72 | 48,000 | 1.0 | 0.3 | $6.8 \times 10^3$ | 0.5 | Yes |
| Crystalline polyester resin 8 | 68 | 12,000 | 1.9 | 0.9 | $5.7 \times 10^2$ | 0.6 | Yes |
| Crystalline polyester resin 9 | 73 | 52,000 | 0.9 | 0.3 | $1.2 \times 10^4$ | 0.4 | Yes |
| Crystalline polyester resin 10 | 67 | 8,500 | 2.2 | 1.2 | $4.0 \times 10^2$ | 0.6 | Yes |
| Crystalline polyester resin 11 | 70 | 38,000 | 1.2 | 0.6 | $4.8 \times 10^5$ | 0.7 | Yes |
| Crystalline polyester resin 12 | 70 | 225,000 | 1.5 | 0.7 | $1.2 \times 10^2$ | 0.5 | Yes |
| Crystalline polyester resin 13 | 70 | 42,000 | 1.1 | 0.5 | $5.2 \times 10^5$ | 0.5 | Yes |
| Crystalline polyester resin 14 | 70 | 23,000 | 1.7 | 0.8 | $8.2 \times 10$ | 0.5 | Yes |
| Crystalline polyester resin 15 | 70 | 15,000 | 1.8 | 0.8 | $2.5 \times 10$ | 0.4 | Yes |

~Preparation of Dispersion of Crystalline Polyester Resin~

In a 2-L container made of metal, 100 g of [crystalline polyester resin 1] and 400 g of ethyl acetate were placed, which were dissolved by heating at 75° C. and then quenched at a rate of 27° C./min in an ice-water bath. To this, 500 mL of glass beads (diameter 3 mm) were added, which was ground for 10 hours by a batch sand mill apparatus (manufactured by Kanpe Hapio Co., Ltd.), and [crystalline polyester dispersion 1] was obtained.

Also, [crystalline polyester dispersion 2] was obtained similarly by changing [crystalline polyester resin 1] to [crystalline polyester resin 2].

Also, [crystalline polyester dispersion 3] was obtained similarly by changing [crystalline polyester resin 1] to [crystalline polyester resin 3].

Also, [crystalline polyester dispersion 4] was obtained similarly by changing [crystalline polyester resin 1] to [crystalline polyester resin 4].

Also, [crystalline polyester dispersion 5] was obtained similarly by changing [crystalline polyester resin 1] to [crystalline polyester resin 5].

Also, [crystalline polyester dispersion 6] was obtained similarly by changing [crystalline polyester resin 1] to [crystalline polyester resin 6].

Also, [crystalline polyester dispersion 7] was obtained similarly by changing [crystalline polyester resin 1] to [crystalline polyester resin 7].

Also, [crystalline polyester dispersion 8] was obtained similarly by changing [crystalline polyester resin 1] to [crystalline polyester resin 8].

Also, [crystalline polyester dispersion 9] was obtained similarly by changing [crystalline polyester resin 1] to [crystalline polyester resin 9].

Also, [crystalline polyester dispersion 10] was obtained similarly by changing [crystalline polyester resin 1] to [crystalline polyester resin 10].

Also, [crystalline polyester dispersion 11] was obtained similarly by changing [crystalline polyester resin 1] to [crystalline polyester resin 11].

Also, [crystalline polyester dispersion 12] was obtained similarly by changing [crystalline polyester resin 1] to [crystalline polyester resin 12].

Also, [crystalline polyester dispersion 13] was obtained similarly by changing [crystalline polyester resin 1] to [crystalline polyester resin 13].

Also, [crystalline polyester dispersion 14] was obtained similarly by changing [crystalline polyester resin 1] to [crystalline polyester resin 14].

Also, [crystalline polyester dispersion 15] was obtained similarly by changing [crystalline polyester resin 1] to [crystalline polyester resin 15].

Example 1

~Synthesis of Non-Crystalline Polyester~

In a 5-liter four-necked flask equipped with a nitrogen inlet tube, a dehydration tube, a stirrer and a thermocouple, 229 parts of ethylene oxide 2-mole adduct of bisphenol A, 529 parts of propylene oxide 3-mole adduct of bisphenol A, 100 parts of isophthalic acid, 108 parts of terephthalic acid, 46 parts of adipic acid and 2 parts of dibutyltin oxide were placed. This was reacted under a normal pressure at 230° C. for 10 hours and further reacted at a reduced pressure of 10 mmHg to 15 mmHg for 5 hours. Thereafter, 30 parts of trimellitic anhydride was added in the reactor, which was reacted under a normal pressure at 180° C. for 3 hours, and [non-crystalline polyester 1] was obtained. The obtained [non-crystalline polyester 1] had a number-average molecular weight of 1,800, a weight-average molecular weight of 5,500, a glass transition temperature (Tg) of 50° C., and an acid value of 20 mgKOH/g.

~Synthesis of Polyester Prepolymer (Binder Resin Precursor)~

In a reactor having a cooling tube, a stirrer and a nitrogen inlet tube, 682 parts of ethylene oxide 2-mole adduct of bisphenol A, 81 parts of propylene oxide 2-mole adduct of bisphenol A, 283 parts of terephthalic acid, 22 parts of trimellitic anhydride and 2 parts of dibutyltin oxide were placed. This was reacted under a normal pressure at 230° C. for 8 hours and further reacted at a reduced pressure of 10 mmHg to 15 mmHg for 5 hours, and [intermediate polyester 1] was obtained.

The obtained [intermediate polyester 1] had a number-average molecular weight of 2,100, a weight-average molecular weight of 9,500, a glass transition temperature (Tg) of 55° C., an acid value of 0.5 mgKOH/g, and a hydroxyl value of 51 mgKOH/g.

Next, in a reactor having a cooling tube, a stirrer and a nitrogen inlet tube, 410 parts of [intermediate polyester 1], 89 parts of isophorone diisocyanate and 500 parts ethyl acetate were placed, which was reacted at 100° C. for 5 hours, and [prepolymer 1] was obtained. [Prepolymer 1] had a free isocyanate of 1.53% by mass.

~Synthesis of Ketimine~

A reactor to which a stirring rod and a thermometer have been set was charged with 170 parts of isophorone diamine and 75 parts of methyl ethyl ketone, which was reacted at 50° C. for 5 hours, and [ketimine compound I] was obtained. [Ketimine compound 1] had an amine value of 418.

~Preparation of Masterbatch (MB)~

In a HENSCHEL mixer (manufactured by Mitsui Mining Co., Ltd.), 1,200 parts of water, 540 parts of carbon black (PRINTEX35, manufactured by Degussa) [DBP oil absorption=42 mL/100 mg, pH=9.5], and 1,200 parts of non-crystalline polyester resin 1 were added and mixed, and the mixture was kneaded using two rolls at 150° C. for 30 minutes. This was rolled to cool, followed by pulverization by a pulverizer, and [masterbatch 1] was obtained.

~Preparation of Oil Phase~

A container to which a stirring rod and a thermometer were set was charged with 378 parts of [non-crystalline polyester 1] above, 110 parts of carnauba wax, 22 parts of CCA (salicylic acid metal complex E-84, manufactured by Orient Chemical Industries Co., Ltd.), and 947 parts of ethyl acetate. This was heated with stirring to 80° C., maintained at 80° C. for 5 hours, and then cooled over 1 hour to 30° C. Next, the container was charged with 500 parts of [masterbatch 1] and 500 parts of ethyl acetate, which was mixed for 1 hour, and [raw material solution 1] was obtained.

To a container, 1,324 parts of [raw material solution 1] was moved, and using a bead mill (ULTRA VISCO MILL, manufactured by Aimex Co., Ltd.), the carbon black and the wax were dispersed by running 3 passes under the following conditions: a liquid feed rate was 1 kg/hr; a peripheral speed of a disk was 6 m/s; zirconia beads having a diameter of 0.5 mm were packed by 80% by volume. Next, 1042.3 parts of an 65-% ethyl acetate solution of [non-crystalline polyester 1] was added, followed by running one path under the above conditions, and [pigment and wax dispersion 1] was obtained. [Pigment and wax dispersion 1] had a solid content concentration (130° C., 30 minutes) of 50%.

~Synthesis of Emulsion of Organic Fine Particles~

A reactor to which a stirring rod and a thermometer was set was charged with 683 parts of water, 11 parts of a sodium salt of sulfate of methacrylic acid ethylene oxide adduct (ELEMINOL RS-30, manufactured by Sanyo Chemical Industries, Ltd.), 138 parts of styrene, 138 parts of methacrylic acid, and 1 part of ammonium persulfate, which was stirred at 400 rpm for 15 minutes, and a white emulsion was obtained. This was heated until a temperature in the system reached 75° C. and reacted for 5 hours. Further, it was added with 30 parts of a 1-% ammonium persulfate aqueous solution and aged at 75° C. for 5 hours, and an aqueous dispersion of a vinyl resin (a copolymer of styrene—methacrylic acid—sodium salt of sulfate of methacrylic acid ethylene oxide adduct) [fine particles dispersion 1] was obtained. A volume-average particle diameter of the obtained [fine particles dispersion 1] was measured with LA-920 (manufactured by Horiba Ltd.) and found to be 0.14 μm. A part of [fine particles dispersion 1] was dried and the resin content was isolated.

~Preparation of Aqueous Phase~

A milky white liquid was obtained by mixing and stirring 990 parts of water, 83 parts of [fine particles dispersion 11, 37 parts of a 48.5-% aqueous solution of sodium dodecyl diphenyl ether disulfonate (ELEMINOL MON-7, manufactured by Sanyo Chemical Industries, Ltd.), and 90 parts of ethyl acetate. This is regarded as [aqueous phase 1].

~Emulsification and Desolvation~

A container was charged with 664 parts of [pigment and wax dispersion 1], 109.4 parts of [prepolymer 1], 73.9 parts of [crystalline polyester dispersion 1], and 4.6 parts of [ketimine compound I], which was mixed with a TK HOMOMIXER (manufactured by Primix Corporation) at 5,000 rpm for 1 minute. In the container, 1,200 parts of [aqueous phase 1] were added, which was mixed with a TK HOMOMIXER at a number of revolutions of 13,000 rpm for 20 minutes, and [emulsified slurry 1] was obtained.

[Emulsified slurry 1] was placed in a container to which a stirrer and a thermometer was set and was subjected to desolvation at 30° C. for 8 hours, followed by aging at 45° C. for 4 hours, and [dispersion slurry 1] was obtained.

~Washing and Drying~

After vacuum filtration of 100 parts of [dispersion slurry 1], a series of operations (1) to (4) was carried out twice, and [filter cake 1] was obtained.

(1) To a filter cake, 100 parts of ion-exchanged water was added, which was mixed by a TK HOMOMIXER (12,000 rpm for 10 minutes), followed by filtration.
(2) To the filter cake of (1), 100 parts of 10-% sodium hydroxide aqueous solution was added, which was mixed by a TK HOMOMIXER (12,000 rpm for 30 minutes), followed by vacuum filtration.
(3) To the filter cake of (2), 100 parts of 10-% hydrochloric acid was added, which was mixed by a TK HOMOMIXER (12,000 rpm for 10 minutes), followed by filtration.
(4) To the filter cake of (3), 300 parts of ion-exchanged water was added, which was mixed by a TK HOMOMIXER (12,000 rpm for 10 minutes), followed by filtration.

[Filter cake 1] was dried in a wind dryer at 45° C. for 48 hours and then sieved with a mesh having openings of 75 μm, and [toner base particles 1] was obtained.

Next, to 100 parts of obtained [toner base particles 1], 1.0 part of hydrophobized silica (HDK-2000, manufactured by Wacker Chemie) was mixed using a HENSCHEL mixer, and [toner 1] of Example 1 was prepared.

Example 2

[Toner 2] was obtained in the same manner as Example 1 except that [crystalline polyester dispersion 1] was replaced by [crystalline polyester dispersion 2] in "emulsification and desolvation" of Example 1.

Example 3

[Toner 3] was obtained in the same manner as Example 1 except that [crystalline polyester dispersion 1] was replaced by [crystalline polyester dispersion 3] in "emulsification and desolvation" of Example 1.

Example 4

[Toner 4] was obtained in the same manner as Example 1 except that [crystalline polyester dispersion 1] was replaced by [crystalline polyester dispersion 4] in "emulsification and desolvation" of Example 1.

Example 5

[Toner 5] was obtained in the same manner as Example 1 except that [crystalline polyester dispersion 1] was replaced by [crystalline polyester dispersion 5] in "emulsification and desolvation" of Example 1.

Example 6

[Toner 6] was obtained in the same manner as Example 1 except that [crystalline polyester dispersion 1] was replaced by [crystalline polyester dispersion 6] in "emulsification and desolvation" of Example 1.

Example 7

[Toner 7] was obtained in the same manner as Example 1 except that [crystalline polyester dispersion 1] was replaced by [crystalline polyester dispersion 7] in "emulsification and desolvation" of Example 1.

Example 8

[Toner 8] was obtained in the same manner as Example 1 except that [crystalline polyester dispersion 1] was replaced by [crystalline polyester dispersion 8] in "emulsification and desolvation" of Example 1.

Example 9

[Toner 9] was obtained in the same manner as Example 1 except that [crystalline polyester dispersion 1] was replaced by [crystalline polyester dispersion 9] in "emulsification and desolvation" of Example 1.

Example 10

[Toner 10] was obtained in the same manner as Example 1 except that [crystalline polyester dispersion 1] was replaced by [crystalline polyester dispersion 10] in "emulsification and desolvation" of Example 1.

Example 11

[Toner 11] was obtained in the same manner as Example 1 except that [crystalline polyester dispersion 1] was replaced by [crystalline polyester dispersion 11] in "emulsification and desolvation" of Example 1.

Example 12

[Toner 12] was obtained in the same manner as Example 1 except that [crystalline polyester dispersion 1] was replaced by [crystalline polyester dispersion 12] in "emulsification and desolvation" of Example 1.

Example 13

[Toner 13] was obtained in the same manner as Example 1 except that [crystalline polyester dispersion 1] was replaced by [crystalline polyester dispersion 13] in "emulsification and desolvation" of Example 1.

Example 14

[Toner 14] was obtained in the same manner as Example 1 except that [crystalline polyester dispersion 1] was replaced by [crystalline polyester dispersion 14] in "emulsification and desolvation" of Example 1.

Example 15

[Toner 15] was obtained in the same manner as Example 1 except that amounts of [pigment and wax dispersion 1] and [crystalline polyester dispersion 1] in "emulsification and desolvation" of Example 1 were changed to 524 parts and 423.9 parts, respectively.

Example 16

[Toner 16] was obtained in the same manner as Example 1 except that [ketimine compound I] was replaced by propylene oxide 2-mole adduct of bisphenol A in "emulsification and desolvation" of Example 1.

Example 17

[Toner 17] was obtained in the same manner as Example 1 except that amounts of [pigment and wax dispersion 1] and [crystalline polyester dispersion 1] in "emulsification and desolvation" of Example 1 were changed to 480 parts and 533.9 parts, respectively.

Comparative Example 1

[Toner 18] was obtained in the same manner as Example 1 except that [crystalline polyester dispersion 1] was replaced by [crystalline polyester dispersion 15] in "emulsification and desolvation" of Example 1.

Comparative Example 2

[Toner 19] was obtained in the same manner as Example 1 except that the amount of [crystalline polyester dispersion 1] in "emulsification and desolvation" of Example 1 was changed from 73.9 parts to 0 parts.

Comparative Example 3

—Production of Wax Dispersion—

A reactor equipped with a cooling tube, a thermometer and a stirrer was charged with 20 parts of paraffin wax (HNP-9 (melting point 75° C.), manufactured by Nippon Seiro Co., Ltd.) and 80 parts of ethyl acetate, which was heated to 78° C. for sufficient dissolution. After it was cooled with stirring over 1 hour to 30° C., it was wet-milled in a ULTRA VISCO MILL (manufactured by Aimex Co., Ltd.) by running 6 passes under the following conditions: a liquid feed rate was 1.0 kg/hr; a peripheral speed of a disk was 10 m/s; zirconia beads having a diameter of 0.5 mm were packed by 80% by volume, and [wax dispersion] was obtained.

—Preparation of Oil Phase—

A container equipped with a thermometer and a stirrer was charged with 80 parts of [crystalline polyester 1] and 60 parts of ethyl acetate, and it was heated to a melting point or greater of [crystalline polyester 1] for good dissolution. To this, 40 parts of a 50-% by mass ethyl acetate solution of [non-crystalline polyester 1], 20 parts of [wax dispersion], 15 parts of [masterbatch 1] and 47 parts of ethyl acetate were added, which was stirred at 50° C. at 10,000 rpm by a TK HOMOMIXER (manufactured by Primix Corporation) for uniform dissolution and dispersion, and [oil phase 20] was obtained. Here, a temperature of [oil phase 20] in the container maintained at 50° C., and it was used within 5 hours from the preparation to avoid crystallization.

—Emulsification and Desolvation—

Next, in a separate container to which a stirrer and a thermometer were set, 90 parts of ion-exchanged water, 3 parts of a 5-% by mass aqueous solution of polyoxyethylene lauryl ether type nonionic surfactant (NL450, manufactured by Daiichi Kogyo Seiyaku Co., Ltd.), and 10 parts of ethyl acetate were mixed and stirred at 40° C. to prepare an aqueous phase solution. This was added with 50 parts of [oil phase 20] maintained at 50° C. and mixed at 40° C. to 50° C. with a TK HOMOMIXER (manufactured by Primix Corporation) at a number of revolutions of 13,000 rpm for 1 minute, and [emulsified slurry 20] was obtained.

A container to which a stirrer and a thermometer was set was charged with [emulsified slurry 20], which was subjected to desolvation at 60° C. for 6 hours, and [slurry 20] was obtained.

After 100 parts of obtained [slurry 20] of toner base particles were subjected to vacuum filtration, a series of washing operations (1) to (4) below was carried out twice, and [filter cake 20] was obtained.

(1) A filter cake was added with 100 parts of ion-exchanged water and mixed by a TK HOMOMIXER (at 6,000 rpm for 5 minutes), followed by filtration.
(2) The filter cake of (1) was added with 100 parts of a 10-% by mass sodium hydroxide aqueous solution and mixed by a TK HOMOMIXER (at 6,000 rpm for minutes), followed by vacuum filtration.
(3) The filter cake of (2) was added with 100 parts of 10-% by mass hydrochloric acid and mixed by a TK HOMOMIXER (at 6,000 rpm for 5 minutes), followed by filtration.
(4) The filter cake of (3) was added with 300 parts of ion-exchanged water and mixed by a TK HOMOMIXER (at 6,000 rpm for 5 minutes), followed by filtration.

Obtained [filter cake 20] was dried in a wind dryer at 45° C. for 48 hours. Thereafter, it was sieved with a mesh having openings of 75 μm, and [toner base particles 20] was prepared.

Next, 100 parts of obtained [toner base particles 20] were mixed with 1.0 part of hydrophobicity silica (HDK-2000, manufactured by Wacker Chemie) using a HENSCHEL mixer, and [toner 20] of Comparative Example 3 was prepared.

Comparative Example 4

[Toner 21] was obtained in the same manner as Comparative Example 3 except that the amount of the 50-% by mass ethyl acetate solution of [non-crystalline polyester 1] in "preparation of oil phase" of Comparative Example 3 was changed to 144 parts.

Developers respectively composed of 5% by mass of the toners as obtained above treated with the external additive and 95% by mass of a copper-zinc ferrite carrier coated with a silicone resin and having an average particles diameter of 40 μm were prepared and evaluated for their fixability, heat-resistant storage stability, image graininess, sharpness, filming, and fogging according to the following evaluation methods. Evaluation results are shown below in Table 2-2.

Also, evaluation results of glass transition temperatures of the obtained toners (Tg1st-Tg2nd) are included in Table 2-1 below.

(Fixability)

Using an apparatus that a fixing member of a digital full-color copying machine (IMAGIO MP C4500, manufactured by Ricoh Company, Ltd.) was modified, a copying test was carried out on TYPE 6200 paper (manufactured by Ricoh Company, Ltd.).

Specifically, by varying a fixing temperature, a cold offset temperature (lower-limit fixing temperature) and a hot offset temperature (upper-limit fixing temperature) were obtained.

As evaluation conditions, a linear velocity of a paper feed was 200 mm/sec to 220 mm/sec, surface pressure was 1.0 kgf/cm$^2$, and nip width was 10.0 mm.

The lower-limit fixing temperature was defined as a minimum temperature at which no cold offset occurs when non-fixed images were fed with a temperature setting of the fixing member varied at an increment of 2° C.

The upper-limit fixing temperature was defined as a maximum temperature at which no hot offset occurs when non-fixed images were fed with a temperature setting of the fixing member varied at an increment of 2° C.

(Heat-Resistant Storage Stability)

After the toners were stored at 45° C. and a relative humidity of 70% for 24 hours, the toners were sieved with a 42-mesh sieve for 2 minutes, and a rate of the toners remaining on the wire mesh was measured.

At this time, the toner remaining rate is smaller for a toner having more favorable heat-resistant storage stability.

Here, heat-resistant storage stability was evaluated as: A for the toner remaining rate of less than 10% by mass; B for the toner remaining rate of 10% by mass or greater and less than 20% by mass; C for the toner remaining rate of 20% by mass or greater and less than 30%; and D for the toner remaining rate of 30% by mass or greater.

(Image Graininess, Sharpness)

After running output of 1,000,000 sheets of a photographic image in a monochrome mode using a digital full-color copying machine (IMAGIO MP C4500, manufactured by Ricoh Company, Ltd.), degrees of graininess and sharpness (image quality) were visually evaluated. In order from the favorable, the evaluation was: "A" as comparable to offset printing; "B" as about slightly worse than offset printing; "C" as about considerably worse than offset printing; and "D" as about conventional electrophotographic image (very bad).

(Filming)

A photoconductor after forming 1,000,000 sheets of an image using a digital full-color copying machine (IMAGIO MP C4500, manufactured by Ricoh Company, Ltd.) was visually examined, and whether or not fixation of a toner component, mainly crystalline polyester and a releasing agent, to the photoconductor occurred was evaluated based on the following evaluation criteria.

<Filming Evaluation Criteria>

A: Fixation of the toner component to the photoconductor was not confirmed.

B: Fixation of the toner component to the photoconductor was confirmed, but it was not at a level that would be a problem in practical use.

C: Fixation of the toner component to the photoconductor was confirmed, and it was at a level that would be a problem in practical use.

D: Fixation of the toner component to the photoconductor was confirmed, and it was at a level that would be a big problem in practical use.

(Fogging)

Using a digital full-color copying machine (IMAGIO MP C4500, manufactured by Ricoh Company, Ltd.) including a cleaning blade and charging roller in contact with a photoconductor, 1,000,000 sheets of a A4-size lateral chart in which a black solid and a white solid were repeated at intervals of 1 cm (image pattern A) were output in a direction perpendicular to a rotational direction of a developing sleeve. Thereafter, a black image was output, which was visually examined for a presence or absence of fogging and evaluated based on the following evaluation criteria.

<Fogging Evaluation Criteria>

A: No fogging at all

B: Fogging was confirmed, but it was not at a level that would be a problem in practical use.

C: Fogging was confirmed, and it was at a level that would be a problem in practical use.

D: Fogging was confirmed, and it was at a level that would be a big problem in practical use.

Evaluation results of Examples 1 to 17 and Comparative Examples 1 to 4 are shown in Table 2-2 below.

TABLE 2-1

| | Content of non-crystalline polyester (%) | Tg1st | Tg2nd | Tg1st – Tg2nd |
|---|---|---|---|---|
| Ex. 1 | 66 | 55 | 30 | 25 |
| Ex. 2 | 66 | 52 | 28 | 24 |
| Ex. 3 | 66 | 56 | 35 | 21 |
| Ex. 4 | 66 | 56 | 38 | 18 |
| Ex. 5 | 66 | 50 | 27 | 23 |
| Ex. 6 | 66 | 55 | 44 | 11 |
| Ex. 7 | 66 | 55 | 32 | 23 |
| Ex. 8 | 66 | 54 | 30 | 24 |
| Ex. 9 | 66 | 55 | 35 | 20 |
| Ex. 10 | 66 | 51 | 28 | 23 |
| Ex. 11 | 66 | 55 | 32 | 23 |
| Ex. 12 | 66 | 54 | 30 | 24 |
| Ex. 13 | 66 | 55 | 35 | 20 |
| Ex. 14 | 66 | 51 | 28 | 23 |
| Ex. 15 | 52 | 54 | 25 | 29 |
| Ex. 16 | 66 | 54 | 28 | 26 |
| Ex. 17 | 48 | 54 | 22 | 32 |
| Comp. Ex. 1 | 66 | 53 | 35 | 18 |
| Comp. Ex. 2 | 69 | 56 | 50 | 6 |
| Comp. Ex. 3 | 25 | 58 | 52 | 6 |
| Comp. Ex. 4 | 48 | 56 | 48 | 8 |

TABLE 2-2

| | Lower-limit fixing temperature (° C.) | Upper-limit fixing temperature (° C.) | Heat-resistant storage stability | Image quality | Filming | Fogging |
|---|---|---|---|---|---|---|
| Ex. 1 | 110 | 200 | A | A | A | A |
| Ex. 2 | 110 | 190 | A | A | A | A |
| Ex. 3 | 110 | 200 | A | A | A | A |
| Ex. 4 | 120 | 200 | A | A | A | A |
| Ex. 5 | 110 | 190 | B | B | B | B |
| Ex. 6 | 120 | 200 | B | A | B | A |
| Ex. 7 | 110 | 200 | A | A | A | A |
| Ex. 8 | 110 | 195 | A | A | A | A |
| Ex. 9 | 120 | 200 | A | A | A | A |
| Ex. 10 | 110 | 185 | B | B | B | B |
| Ex. 11 | 110 | 200 | A | A | A | A |
| Ex. 12 | 110 | 195 | A | A | A | A |
| Ex. 13 | 120 | 200 | A | A | A | B |
| Ex. 14 | 120 | 185 | A | A | B | B |
| Ex. 15 | 110 | 180 | A | A | B | B |
| Ex. 16 | 110 | 195 | A | A | A | A |
| Ex. 17 | 115 | 170 | B | B | B | B |
| Comp. Ex. 1 | 130 | 180 | C | C | C | C |

TABLE 2-2-continued

| | Lower-limit fixing temperature (° C.) | Upper-limit fixing temperature (° C.) | Heat-resistant storage stability | Image quality | Film-ing | Fog-ging |
|---|---|---|---|---|---|---|
| Comp. Ex. 2 | 140 | 200 | A | A | A | A |
| Comp. Ex. 3 | 130 | 160 | D | D | D | D |
| Comp. Ex. 4 | 130 | 160 | C | C | C | C |

As above, toners having superior low-temperature fixing property and heat-resistant storage stability were obtained in Examples 1 to 17. Also, in Comparative Example 1, although the toner included a crystalline polyester resin, the crystalline polyester was not modified, and the results indicated inferior low-temperature fixing property, heat-resistant storage stability, and image quality.

Also, in Comparative Example 2, since the toner included no crystalline polyester resin, the results indicated severely inferior low-temperature fixing property.

Also, in Comparative Examples 3 to 4, although the toner included modified crystalline polyester, the difference between Tg1st and Tg2nd (Tg1st−Tg2nd) was less than 10° C., and the results indicated inferior low-temperature fixing property, heat-resistant storage stability, or image quality.

Aspects of the present invention are as follows.

<1> A toner, including at least:

a non-crystalline polyester resin; and a crystalline polyester resin, wherein the toner has a glass transition temperature in a first heating Tg1st and a glass transition temperature in a second heating Tg2nd, and a difference between Tg1st and Tg2nd (Tg1st-Tg2nd) is 10° C. or greater, and wherein the crystalline polyester resin is a modified crystalline polyester resin having a urethane skeleton or a urea skeleton, or both thereof.

<2> The toner according to <1>, wherein the modified crystalline polyester resin has a melting point of 50° C. or greater and less than 80° C., and wherein the modified crystalline polyester resin includes a structural unit derived from an aliphatic dicarboxylic acid and a structural unit derived from an aliphatic diol.

<3> The toner according to any one of <1> to <2>, wherein, in a GPC measurement of a component soluble to ortho-dichlorobenzene of the modified crystalline polyester resin, a weight-average molecular weight Mw is 10,000 to 50,000, a ratio of a component having a molecular weight of 1,000 or less is less than 2% by mass, and a ratio of a component having a molecular weight of 500 or less is less than 1% by mass.

<4> The toner according to any one of <1> to <3>, wherein the modified crystalline polyester resin has a storage elastic modulus G' at a melting point+20° C. of $1.0\times10^2$ Pa·s or greater and less than $5.0\times10^5$ Pa·s.

<5> The toner according to any one of <1> to <4>, wherein the difference between the glass transition temperature in a first heating Tg1st and the glass transition temperature in a second heating Tg2nd (Tg1st-Tg2nd) is less than 30° C.

<6> The toner according to any one of <1> to <5>, wherein a content of the modified crystalline polyester resin is 5% by mass or greater and less than 20% by mass.

<7> The toner according to any one of <1> to <6>, wherein the toner is subjected to granulation by dispersing an oil phase including at least the non-crystalline polyester resin, the modified crystalline polyester resin, a releasing agent and a colorant in an aqueous medium.

<8> The toner according to <7>, wherein the granulation in the aqueous medium is carried out by: dispersing the oil phase in an organic solvent to prepare a dispersion, wherein the oil phase includes at least a compound having an active hydrogen group, a polymer having a portion capable of reacting with the compound having an active hydrogen group, the non-crystalline polyester resin, the modified crystalline polyester resin, the releasing agent, and the colorant dissolved or dispersed;

subjecting the compound having an active hydrogen group and the polymer having a portion capable of reacting with the compound having an active hydrogen group to a crosslinking or an elongation reaction in the aqueous medium; and removing the organic solvent from the obtained dispersion.

<9> A developer, including the toner according to any one of <1> to <8>.

<10> An image forming method, including at least:

an electrostatic latent image formation step, where an electrostatic latent image is formed on an electrostatic latent image bearing member;

a developing step, where the electrostatic latent image is developed with a toner to form a visible image;

a transfer step, where the visible image is transferred to a recording medium; and a fixing step, where a transfer image transferred on the recording medium is fixed, wherein the toner is the toner according to any one of <1> to <8>.

This application claims priority to Japanese applications No. 2011-274074, filed on Dec. 15, 2011 and No. 2012-211947, filed on Sep. 26, 2012, and incorporated herein by reference.

What is claimed is:

1. A toner, comprising:

a non-crystalline polyester resin; and a crystalline polyester resin, wherein the toner has a glass transition temperature in a first heating Tg1st and a glass transition temperature in a second heating Tg2nd, and a difference between Tg1st and Tg2nd (Tg1st-Tg2nd) is 10° C. or greater, and wherein the crystalline polyester resin is a modified crystalline polyester resin having a urethane skeleton or a urea skeleton, or both thereof.

2. The toner according to claim 1, wherein the modified crystalline polyester resin has a melting point of 50° C. or greater and less than 80° C., and wherein the modified crystalline polyester resin comprises a structural unit derived from an aliphatic dicarboxylic acid and a structural unit derived from an aliphatic diol.

3. The toner according to claim 1, wherein, in a GPC measurement of a component soluble to ortho-dichlorobenzene of the modified crystalline polyester resin, a weight-average molecular weight Mw is 10,000 to 50,000, a ratio of a component having a molecular weight of 1,000 or less is less than 2% by mass, and a ratio of a component having a molecular weight of 500 or less is less than 1% by mass.

4. The toner according to claim 1, wherein the modified crystalline polyester resin has a storage elastic modulus G' at a melting point +20° C. of $1.0\times10^2$Pa·s or greater and less than $5.0\times10^5$Pa·s or greater and less than $5.0\times10^5$Pa·s.

5. The toner according to claim 1, wherein the difference between the glass transition temperature in a first heating Tg1st and the glass transition temperature in a second heating Tg2nd (Tg1st-Tg2nd) is less than 30° C.

6. The toner according to claim 1, wherein a content of the modified crystalline polyester resin is 5% by mass or greater and less than 20% by mass.

7. The toner according to claim 1, wherein the toner is subjected to granulation by dispersing an oil phase including at least the non-crystalline polyester resin, the modified crystalline polyester resin, a releasing agent and a colorant in an aqueous medium.

8. The toner according to claim 7, wherein the granulation in the aqueous medium is carried out by: dispersing the oil phase in the aqueous medium to prepare a dispersion, wherein the oil phase comprises a compound having an active hydrogen group, a polymer having a portion capable of reacting with the compound having an active hydrogen group, the non-crystalline polyester resin, the modified crystalline polyester resin, the releasing agent, and the colorant dissolved or dispersed in an organic solvent;

subjecting the compound having an active hydrogen group and the polymer having a portion capable of reacting with the compound having an active hydrogen group to a crosslinking or an elongation reaction in the aqueous medium; and removing the organic solvent from the obtained dispersion.

9. A developer, comprising:

a toner comprising a non-crystalline polyester resin and a crystalline polyester resin, wherein the toner has a glass transition temperature in a first heating Tg1st and a glass transition temperature in a second heating Tg2nd, and a difference between Tg1st and Tg2nd (Tg1st-Tg2nd) is 10° C. or greater, and wherein the crystalline polyester resin is a modified crystalline polyester resin having a urethane skeleton or a urea skeleton, or both thereof.

10. An image forming method, comprising:

forming an electrostatic latent image, wherein an electrostatic latent image is formed on an electrostatic latent image bearing member;

developing, wherein the electrostatic latent image is developed with a toner to form a visible image;

transferring, wherein the visible image is transferred on a recording medium; and fixing, wherein a transfer image transferred on the recording medium is fixed, wherein the toner contains a non-crystalline polyester resin, and a crystalline polyester resin, wherein the toner has a glass transition temperature in a first heating Tg1st and a glass transition temperature in a second heating Tg2nd, and a difference between Tg1st and Tg2nd (Tg1st-Tg2nd) is 10° C. or greater, and wherein the crystalline polyester resin is a modified crystalline polyester resin having a urethane skeleton or a urea skeleton, or both thereof.

* * * * *